US010913103B2

(12) United States Patent
Zhou et al.

(10) Patent No.: US 10,913,103 B2
(45) Date of Patent: Feb. 9, 2021

(54) METHOD, MODULE, AND APPARATUS FOR ROLL-PROCESSING EXTERNAL PIPE THREAD, AND EXTERNAL PIPE THREAD PRODUCTION LINE

(71) Applicant: Jun Zhou, Shanghai (CN)

(72) Inventors: Jun Zhou, Shanghai (CN); Yongliang Zhang, Shanghai (CN); Jianming Yang, Shanghai (CN); Minjun Yang, Shanghai (CN)

(73) Assignee: Jun Zhou, Shanghai (CN)

( * ) Notice: Subject to any disclaimer, the term of this patent is extended or adjusted under 35 U.S.C. 154(b) by 320 days.

(21) Appl. No.: 15/735,518

(22) PCT Filed: Jun. 8, 2016

(86) PCT No.: PCT/CN2016/085368
§ 371 (c)(1),
(2) Date: Dec. 11, 2017

(87) PCT Pub. No.: WO2016/197960
PCT Pub. Date: Dec. 15, 2016

(65) Prior Publication Data

US 2018/0169738 A1 Jun. 21, 2018

(30) Foreign Application Priority Data

Jun. 10, 2015 (CN) ..... 2015 1 0317107
Nov. 25, 2015 (CN) ..... 2015 1 0829695

(51) Int. Cl.
*B21H 3/04* (2006.01)
*B21H 3/02* (2006.01)

(52) U.S. Cl.
CPC ..... *B21H 3/042* (2013.01); *B21H 3/02* (2013.01); *B21H 3/04* (2013.01)

(58) Field of Classification Search
CPC . B21H 3/02; B21H 3/04; B21H 3/042; B21H 3/044; B21H 3/046; B21H 3/048
See application file for complete search history.

(56) References Cited

U.S. PATENT DOCUMENTS 2,017,386 A * 10/1935 Bannister ..... B21B 19/08 72/97
4,712,407 A 12/1987 Yoshiki et al.
(Continued)

FOREIGN PATENT DOCUMENTS

CN 1555938 12/2004
CN 102423789 4/2012
(Continued)

OTHER PUBLICATIONS

International Search Report for international application No. PCT/CN2016/085368, dated Aug. 24, 2016 (4 pages, including English translation).
(Continued)

*Primary Examiner* — Pradeep C Battula
(74) *Attorney, Agent, or Firm* — Hamre, Schumann, Mueller & Larson, P.C.

(57) ABSTRACT

Provided is a method for performing an external pipe thread process on a hollow blank by at least twice rolling, wherein amount of rolling wheels in a rolling wheel set, used in any two back-to-back rolling processes in a processing sequence, are different in parity. Further provided are various roll-processing modules and corresponding rolling apparatuses, achieving the above processing method and having a simple structure, portability and practicality. A hollow blank is not liable to deform when performing an external pipe thread rolling process thereon, thereby improving a processing yield.

3 Claims, 24 Drawing Sheets

(56) References Cited

U.S. PATENT DOCUMENTS

| | | | | |
|---|---|---|---|---|
| 2008/0010807 | A1* | 1/2008 | Fujii | B21H 3/046<br>29/558 |
| 2010/0113172 | A1* | 5/2010 | Braun | B21H 3/04<br>470/57 |
| 2011/0023569 | A1* | 2/2011 | Inage | B21B 19/04<br>72/69 |
| 2015/0258600 | A1* | 9/2015 | Zhou | B21H 3/042<br>138/109 |
| 2016/0136721 | A1* | 5/2016 | Zhou | B21H 3/04<br>72/114 |
| 2016/0354834 | A1* | 12/2016 | Silberkuhl | B21H 3/044 |

FOREIGN PATENT DOCUMENTS

| | | |
|---|---|---|
| CN | 103521666 | 1/2014 |
| CN | 204276766 | 4/2015 |
| CN | 105121052 | 12/2015 |
| JP | S6027423 | 2/1985 |
| SU | 782937 A1 | 11/1980 |

OTHER PUBLICATIONS

The partial supplementary European search report issued in European Application No. 16806858.3, dated Oct. 4, 2018, 14 pages provided.

* cited by examiner a b c a b c a b c a b a b a b a b a b a b a b

METHOD, MODULE, AND APPARATUS FOR ROLL-PROCESSING EXTERNAL PIPE THREAD, AND EXTERNAL PIPE THREAD PRODUCTION LINE

TECHNICAL FIELD

The present invention relates to a method, a module, an apparatus for rolling external pipe thread and an external pipe thread production line of a steel pipe or a hollow blank, especially a common steel pipe, belonging to the pipe processing mechanical field.

BACKGROUND

Compared with the external pipe thread by cutting, the external pipe thread by rolling has significant advantages of good quality, good sealing performance and high mechanical connection strength, and is valued by more and more people. However, outer diameter, wall thickness and other parameters of existing general steel pipe are formulated based on the cutting process requirements. For the rolling process, the outer diameter is too large and the steep pipe has a certain degree of non-roundness. The both constitute two biggest problems for rolling an external pipe thread. In the prior art, the problem of the large outer diameter can be solved by methods such as axial punching of a conical surface or a cylindrical surface or a radial rolling to reduce diameter, or using a medium-diameter pipe conforming to the rolling requirement. The method adopted at present for solving the irregularity of non-roundness problem is a kind of axially punched perfect conical surface disclosed in patent CN1251820C or a method of firstly cutting the perfect conical surface with the tool in the external pipe thread section of the steel pipe for processing pipe and then performing the conical external pipe thread rolling processing disclosed by the patent CN2582780Y.

Axially punching has the problems of complex apparatus and damage to the steel pipe, and firstly cutting the perfect conical surface with the tool in the external pipe thread section needs high processing precision, such as high concentricity of the workpiece and the tool, which can not be easily achieved in construction site for installing the pipe network. As a result, the market needs new external pipe thread processing technology and pipe external pipe thread processing apparatus which has reasonable structural design and high applicability.

SUMMARY

The purpose of the present invention is to provide a method, a module and an apparatus for rolling external pipe thread and a rolling production line thereof with high applicability. More specifically, the present invention provides a method, module, an apparatus and a rolling production line that can use conventional steel pipe having a standard outer diameter and non-roundness as a blank, without applying a preparatory process that need a die stamping or cutting a conical surface with a tool, and complete the preparation process by the pre-rolling of the present invention, and then form external pipe thread by rolling.

In one aspect, the present invention provides a rolling method for forming an external pipe thread, comprising rolling a hollow blank in sequence by a first rolling wheel group and a second rolling wheel group, wherein the first rolling wheel group comprises at least four circumferentially arranged first rolling wheels, the second rolling wheel group comprises at least three circumferentially arranged second rolling wheels, wherein the first rolling wheels are rolling wheels with smooth outer surface, and the second rolling wheels have external pipe thread forming portion, and the rolling method includes the following steps:

step 1: the first rolling wheel group rolls the outer surface of the hollow blank into a cylindrical surface, a conical surface, or a cylindrical conical mixing surface;

step 2: the second rolling wheel group rolls the outer surface of the hollow blank processed in the step 1 again, so as to form the external pipe thread by rolling; wherein the number of the first rolling wheels in the first rolling wheel group and the number of the second rolling wheels in the second rolling wheel group is odd-even different.

In a preferred embodiment, the number of the first rolling wheels in the first rolling wheel group is greater than the number of the second rolling wheels in the second rolling wheel group.

In another preferred embodiment, the hollow blank has non-roundness greater than 100 um.

In another preferred embodiment, the rolling process of the first rolling wheel group and the second rolling wheel group is selected from one of the following cooperation:

a, both the rolling process of the first rolling wheel group and the rolling process of the second rolling wheel group are axial rolling;

b, the rolling process of the first rolling wheel group is radial rolling, and the rolling process of the second rolling wheel group is axial rolling;

c, the rolling process of the first rolling wheel group is axial radial mixing rolling, and the rolling process of the second rolling wheel group is axial rolling.

In particular, when the rolling method is used to process external pipe threads on a hollow blank having a size of 2 inches or less, both the number of the first rolling wheels in the first rolling wheel group and the number of the second rolling wheels in the second rolling wheel group is no more than 15, preferably 4, 5, 6, 7, 8, or 9; or when used to process an external pipe thread on a hollow blank having a size between 2 and 4 inches, both the number of the first rolling wheels in the first rolling wheel group and the second rolling wheels in the second rolling wheel group is no more than 19, preferably 4, 5, 6, 7, 8, 9, 10, or 11; or when used to process an external pipe thread on a hollow blank having a size of 4 inches or more, both the number of the first rolling wheels in the first rolling wheel group and the number of the second rolling wheels in the second rolling wheel group is no more than 35, preferably 4, 5, 6, 7, 8, 9, 10, 11, 12, 13, 14, 15, 16, 17, 18, 19 or 20.

In a preferred embodiment of the present invention, the number of the first rolling wheels in the first rolling wheel group is different from the number of the second rolling wheels in the second rolling wheel group by 1 to 11, more preferably by 1, 3, 5 or 7.

In a particularly preferred embodiment of the present invention, the number of the first rolling wheels in the first rolling wheel group is four and the number of the second rolling wheels in the second rolling wheel group is three; or the number of the first rolling wheels in the first rolling wheel group is five and the number of the second rolling wheels in the second rolling wheel group is four; or the number of the first rolling wheels in the first rolling wheel group is six, and the number of the second rolling wheels in the second rolling wheel group is five.

In order to further improve the stability of rolling the external pipe thread, the rolling method for an external pipe thread of the present invention preferably further comprises a chamfering process before performing the rolling process of the step 1, and the cylindrical blanks are cut using chamfering tools to an axial length of 1-3 pitch in the chamfering process.

When processing the conical external pipe thread using the method for rolling external pipe thread of the present invention, the external port diameter of the cylindrical surface or conical surface or the cylindrical conical mixing surface is preferably the port median diameter of the conical external pipe thread plus 5%-90% of the tooth height of the conical external pipe thread, more preferably the port median diameter of the conical external pipe thread plus 15%-85% of the tooth height of the conical external pipe thread.

On the other hand, when processing the conical external pipe thread using the method for rolling external pipe thread of the present invention, the axial length of the cylindrical surface or conical surface or the cylindrical conical mixing surface is greater than or equal to the axial length of the external pipe thread to be processed; preferably 1 to 3 pitch greater, particularly preferably 2 pitch greater.

On the other hand, when processing the conical external pipe thread using the method for rolling external pipe thread of the present invention, preferably the first rolling wheel group rolls the outer surface of the portion of the hollow blank to be provided with thread into a cone surface, and the taper of the cone surface is 2°-5°, preferably 2°30"-4°30".

In a particularly preferred embodiment, the conical external pipe thread is processed using the method for rolling external pipe thread of the present invention, and the first rolling wheel has one or more of the following features:

a) the first rolling wheel is a cylindrical or conical rolling wheel with a smooth outer surface;

b) there is a deflection angle of not more than 9 degrees in the vertical direction between the axis of the first rolling wheels and the axis of the hollow blank to be processed;

c) there is a free-play clearance between the first rolling wheel and the rolling wheel seat on which it is located.

More preferably, the first rolling wheel is a conical rolling wheel with a smooth outer surface, and the axis thereof has a deflection angle of not more than 9 degrees in the vertical direction with respect to the axis of the hollow blank to be processed.

In another preferred embodiment, when processing cylindrical external pipe thread using the method for rolling external pipe thread of the present invention, the external diameter of the port of the cylindrical surface or the conical surface or the cylindrical conical mixing surface is preferably the port median diameter of the cylindrical external pipe thread plus 5%-90% of the tooth height of the cylindrical external pipe thread, more preferably the port median diameter of the cylindrical external pipe thread plus 20%-85 of the tooth height of the cylindrical external pipe thread.

Another aspect of the present invention provides a method for rolling an external pipe thread, which is to perform thread forming rolling on the outer surface of the pre-forming rolled hollow blank, wherein the pre-forming rolling refers to the process of rolling the outer surface of the hollow blank into a cylindrical surface or a conical surface or a cylindrical conical mixing surface by the first rolling wheel group, and the first rolling wheel group comprises at least four circumferentially arranged first rolling wheels with smooth outer surface, and the thread forming rolling is performed by the second rolling wheel group including at least three circumferentially arranged second rolling wheels having a external pipe thread forming portion, and wherein the number of the first rolling wheels in the first rolling wheel group and the number of the second rolling wheels in the second rolling wheel group is odd-even different.

Another aspect of the present invention provides a rolling head comprising at least three circumferentially arranged rolling wheels (8), a first rolling wheel disk (70A), a second rolling wheel disc (70B) and a connecting pin (702), wherein the first rolling wheel disc and the second rolling wheel disc are provided with radial grooves (71), workpiece working holes (704) and pin holes (701) corresponding to each other, and the rolling wheel (8) cooperates with the radial grooves (71) on the first and second rolling wheel discs via its rolling wheel axle (83), and mounting surfaces of the radial grooves (71) for the rolling wheel (8) is an inclined plane (703); the first rolling wheel disc and the second rolling wheel disc are connected and fixed with each other through the connecting pins (702) cooperating with the pin holes (701) to form a rolling head coaxially, and the rolling wheel axle (83) has inclined planes (832*a*, 832*b*) parallel to each other at two ends respectively. The rolling wheel axles (83) are mounted on the radial groove (71) of the rolling wheel disc through the inclined planes (832*a*, 832*b*), wherein the axis of the rolling wheel forms an included angle with the inclined plane (832*a*, 832*b*).

Preferably, the included angle is less than 9 degrees, more preferably less than 3 degrees.

Preferably, the rolling wheel is a rolling wheel with a smooth outer surface, and the rolling wheel has a cutting blade integrally formed with the rolling wheel.

Preferably, the rolling wheel is a conical rolling wheel with a smooth outer surface, and the taper of the conical rolling wheel is 2°-5°, preferably 2°30"-4°30".

In particular, in order to obtain a better rolling effect, in a preferred rolling head embodiment of the invention, the rolling wheel is an annular rolling wheel and has a external pipe thread forming portion, and there is a deflection angle of not more than 9 degrees between the axis of the rolling wheel and the axis of the workpiece working hole in the vertical direction, and there is also an initial part of the thread on the surface of the rolling wheel, and the initial part of the thread refers to the thread that the annular rolling wheel in the thread rolling process firstly contacts with the hollow blank and meets the following conditions:

A total of N annular rolling wheels are arranged in the second rolling head. Starting from one of the annular rolling wheels the initial part of the next rolling wheel $R_{i+1}$ along the same clockwise direction is the thread obtained based on the initial partial thread of the rolling wheel $R_i$ and extending a distance of 1/N pitch according to the original thread profile and pitch in the direction of the rolling wheel Ri axis.

In another preferred embodiment of the rolling head, the rolling head further comprises a first adjusting disc (76A), a second adjusting disc (76B) and an adjusting disc pin (763), and the first adjusting disc and the second adjusting disc are provided with positioning and installing blind holes (766), arc-shaped grooves (762), workpiece working holes (764) and pin holes (761) corresponding to each other; the first adjusting disc and the second adjusting discs are respectively and coaxially mounted on the outer sides of the first rolling wheel disc and the second rolling wheel disc through the positioning and installing blind holes (766), and are mutually connected by the adjusting disc pin (763); both ends of the rolling wheel axle (83) also has an extension (833) on the outside of the inclined plane, the extension (833) of the rolling wheel axle being mounted in the arc-shaped grooves (762) in the adjusting disc, turning the adjusting disc can drive the rolling wheel axle (83) to slide in the arc-shaped grooves (762) so as to drive the rolling wheel axle (83) to move radially in the radial groove (71) of the rolling wheel disc (70);

More preferably, the rolling head further comprises a sliding piece, and the extension of the rolling wheel axle cooperates with a shaft hole of the sliding piece and is installed in the arc-shaped slot (762) of the adjusting disk through the sliding piece 836; rotating the adjusting disc (76) can drive the sliding piece to slide in the arc-shaped groove (762) to drive the rolling wheel axle (83) to move radially in the radial groove (71) of the rolling wheel disc (70); or equivalently more preferably, the rolling head further comprises a control adjusting rod (122) installed at the end of the rolling head on the side where rolling is completed; during the rolling process, when the hollow blank contacts the control adjusting rod (122), the control adjusting rod (122) can drive the photoelectric sensing device to work and control the rotation of the first adjusting disc and the second adjusting disc to control start and stop of the rolling process.

Or equivalently more preferably, the rolling head further comprises a control adjusting lever (121) mounted on the top or the bottom of the rolling head on the side where rolling is completed. During rolling, when the hollow blank contacts the control adjusting lever (121), the control adjusting lever (121) can drive the photoelectric sensing device to work and control the rotation of the first adjusting disc and the second adjusting disc to control the start and stop of the rolling process.

Or equivalently more preferably, relative rotational position angle detecting means (123) is provided between the first rolling wheel disc and the first adjusting disc or between the second rolling wheel disc and the second adjusting disc.

The invention further provides a rolling head comprising at least three circumferentially arranged rolling wheels (8) and their rolling wheel seats and also an upper rolling wheel seat disc (60A2), a threaded upper rolling wheel seat pushrod (60A1), a torque amplification gear group (69), a screw nut (696), a rotation handle (691); the upper rolling wheel seat plate (60A2) is fixedly connected to the upper rolling wheel seat (60A) and sleeved on the guide column (611) to form a shaft hole fitting. One end of the upper rolling wheel seat pushrod (60A1) fixedly abuts on the upper rolling wheel seat plate (60A2), and the other end is matched with the screw nut (696) and coaxially matched with the inner hole of output gear bearing in the torque amplification gear group. The input shaft of the torque amplifying gear group (69) is fixedly connected with the rotation handle (691), and the lower rolling wheel seat plate (60B2) is fixedly connected to the lower rolling wheel seat (60B) and sleeved on the guide column (611) to be fixed. The upper rolling wheel seat pushrod (60A1) is driven to move up and down through the torque amplifying gear group (69) and the screw nut (696) when the rotation handle (691) drives the gear input shaft to rotate; when the hollow cylindrical blank (40) is snapped and rotated by the rolling wheel (81), radial feed rolling of the rolling wheel is completed.

The present invention also provides an external pipe thread rolling apparatus comprising at least one of the above-mentioned rolling heads.

The present invention further provides a module for rolling an external pipe thread, comprising a first rolling head and a second rolling head, wherein the first rolling head comprises at least four circumferentially arranged first rolling wheels; the first rolling wheel is a rolling wheel with a smooth outer surface; and the second rolling head comprises at least three circumferentially arranged second rolling wheels having an external pipe thread forming portion; and the number of the first rolling wheels in the first rolling wheel group and the number of the second rolling wheels in the second rolling wheel group is odd-even different.

Preferably, the number of the first rolling wheels in the first rolling wheel group is greater than the number of the second rolling wheels in the second rolling wheel group.

Preferably, the first rolling wheel is a conical rolling wheel with a smooth outer surface, and the taper of the conical rolling wheel is 2°-5°, preferably 2°30"-4°30".

The present invention also provides a module for rolling an external pipe thread, comprising a first rolling head and a second rolling head which are combined into one body and the first rolling head and the second rolling head are arranged coaxially with the hollow blank to be processed, wherein the first rolling head is arranged on the side close to the start of the external pipe thread processed; more preferably, the first rolling head comprises a corresponding first rolling wheel disc (70A), a second rolling wheel disc (70B) and a connecting pin (763). The first rolling wheel disc (70A) and the second rolling wheel disc (70B) are provided with radial grooves (71), workpiece processing holes (704) and pin holes (701) corresponding to each other. The rolling wheel (8) cooperates with the radial grooves (71) on the first rolling wheel disc (70A) and the second rolling wheel disc (70B) via the rolling wheel axle (83), and mounting surface of the radial groove (71) and the rolling wheel (8) is an inclined plane (703). The first rolling wheel disc (70A) and the second rolling wheel disc (70B) are fixedly connected to each other by a connecting pin (763) matched with the pin hole (701), coaxially formed as the rolling head, and two ends of the rolling wheel axle (83) is provided with inclined planes (832*a*, 832*b*) parallel to each other and the rolling wheel axle (83) is mounted on a radial groove (71) of the rolling wheel disc through the inclined planes (832*a*, 832*b*). The axis X of the rolling wheel forms an included angle with the inclined planes (832*a*, 832*b*), and the included angle is less than 9 degrees, preferably less than 3 degrees, and the first rolling head further comprises a control adjusting rod. The control adjusting rod is installed on the top or the tail of the rolling head on the side where the rolling is finished;

And the second rolling head also comprises a corresponding first rolling wheel disk, a second rolling wheel disk and a connecting pin. The first rolling wheel disk and the second rolling wheel disk are provided with radial grooves, workpiece processing holes, and pin holes corresponding to each other. The rolling wheel cooperates with the radial grooves on the first rolling wheel disc and the second rolling wheel disc via its rolling wheel axle. The first rolling wheel disc and the second rolling wheel disc are fixedly connected to each other by a connecting pin matched with the pin hole, coaxially formed as the rolling head. The second rolling head further comprises a control adjusting rod. The control adjusting rod is installed on the end of the second rolling head on the side where the rolling is finished.

The first rolling head and the second rolling head are coaxially arranged together by a pin.

Particularly preferably, the first rolling head further comprises a corresponding first adjusting disc, a second adjusting disc and an adjusting disc pin. The first adjusting disc and the second adjusting disc are provided with positioning and installing blind holes, arc-shaped grooves, workpiece processing holes and pin holes corresponding to each other. The first adjusting disc and the second adjusting disc are respectively and coaxially mounted on the outer sides of the first rolling wheel disc and the second rolling wheel disc through the positioning and installing blind holes and are mutually connected by the adjusting disc pin. Both ends of the rolling wheel axle further have an extension on the outer side of the inclined plane, and the extension part of the rolling wheel axle is installed in the arc-shaped groove of the adjusting disc. Rotating the adjusting disc can drive the rolling wheel axle to slide in the arc-shaped groove so as to drive the rolling wheel axle to move radially in the radial groove of the rolling wheel disc.

And the second rolling head further comprises a corresponding first adjusting disc, a second adjusting disc and an adjusting disc pin. The first adjusting disc and the second adjusting disc are provided with positioning and installing blind holes, arc-shaped grooves, workpiece processing holes and pin holes corresponding to each other. The first adjusting disc and the second adjusting disc are respectively and coaxially mounted on the outer sides of the first rolling wheel disc and the second rolling wheel disc through the positioning and installing blind holes and are mutually connected by the adjusting disc pin. Both ends of the rolling wheel axle further have an extension on the outer side of the inclined plane, and the extension part of the rolling wheel axle is installed in the arc-shaped groove of the adjusting disc. Rotating the adjusting disc can drive the rolling wheel axle to slide in the arc-shaped groove so as to drive the rolling wheel axle to move radially in the radial groove of the rolling wheel disc.

In another module for rolling external pipe thread according to another embodiment of the present invention, the module for rolling external pipe thread further comprises a first rolling head seat, a second rolling head seat, a transmission device and a power motor. The first rolling head seat is fixedly mounted with the first rolling head, and the second rolling head seat is fixedly mounted with the second rolling head. An input main shaft of the transmission device is mechanically matched with the output main shaft of the power motor, and the output main shaft of the transmission device forms a mechanical cooperation with the first rolling head seat and the second rolling head seat. The power motor may drive the first rolling head seat and the second rolling head seat to rotate through the transmission device, so as to rotate the first rolling head and the second rolling head. Preferably, the mechanical cooperation between the output shaft of the transmission device and the first rolling head seat and the second rolling head seat is a cooperation of a worm and a worm gear. One end of the worm is mechanically matched with the output shaft of the transmission device, and the other end of the worm is matched with a first worm gear and a second worm gear, and the centers of the first worm gear and the second worm gear are respectively provided on the first rolling head seat and the second rolling head seat. More preferably, it further comprises at least one third worm gear and a processing tool head seat mounted on the third worm gear. The processing tool head seat is matched with one of a taper cutting tool, a correction tool for the inner hole of blank, a port surface processing tool and a thread surface processing tool through cooperation of key and groove.

In the another module for rolling external pipe thread as described above, preferably, the end of rolling wheel of any one or more of the first rolling head or the second rolling head is provided with a photoelectric sensing device for controlling the operation of the power motor.

The present invention also provides an apparatus for rolling external pipe thread comprising at least one of the above-mentioned rolling modules.

The present invention also provides a production line for external pipe thread comprising at least one of the above-mentioned rolling modules, and the first rolling head and the second rolling head are respectively mounted on independent rolling devices thereof. The first rolling head and the second rolling head are used to roll the hollow blank in turn.

Japanese Patent JP6039470 discloses a rolling pre-preparation process which rolls a double conical surface on a hollow cylindrical blank and at the same time cuts the workpiece. Chinese patent CN102423789A discloses a rolling pre-preparation process of a radial rolling diameter reduction. However, the problems to be solved by the above two patents are merely the formation of the conical surface of the hollow blank or the diameter reduction of the hollow blank, which does not solve the problem of non-roundness, which is crucial for the subsequent rolling. According to a large number of tests, analysis and research, it was found that due to the outer diameter, out of roundness, wall thickness and uniformity, material, weld quality and residual stress of steel pipe and other effects, in practice, after forming radial rolling (double) conical surface or reducing diameter by radial rolling, its non-roundness will be increased by 30% to 100%, especially for the steel pipe having a non-roundness conforming with the non-roundness national standards but more than 100 um. When the pipe external thread rolling proceeds, its non-roundness will further increase, so it is difficult to directly roll out the pipe external thread on the existing general steel pipe (especially a seam welded pipe), in particular it is difficult to roll out the conical external pipe thread, especially for welded pipes and thin-walled pipes.

The present invention has been systematically tested, analyzed and studied. The present invention discloses the successive causalities between the port outer diameter, the taper and the length of the hollow blank formed by pre-rolling, and the number of the pre-formed spiral line as well as the subsequent thread profile, the length precision and the number of thread rolling spiral line, and creatively adopts the unique idea that the number of the rolling wheels in the two rolling processes is odd-even different, especial preferably, the unique idea that the number of pre-forming rolling wheels is greater than the number of pipe thread forming rolling wheels; on one hand, by using the rolling wheel to contact the hollow blank gradually during the process of pre-forming rolling, the section of the rolling part of the hollow blank is formed by rolling from the original irregular polygons into the controllable and regular polygons. The regular polygon conforms to the subsequent thread rolling requirements, and the non-roundness increase during pre-rolling will not exceed 10% of the original. During this period, some residual stress of hollow blank is also released and the original residual curvature of hollow blank is reduced gradually to make the stress of hollow blank gradually come to uniform; on the other hand, creatively using the technical solution that the number of pipe thread forming rolling wheel and the number of pre-forming rolling wheel matches with each other in odd-even, making the rolling pipe thread rolling wheel at the same time equip with two major functions of rounding and pipe thread forming, the rolled portion having the regular polygons is further formed by rolling into an external pipe thread with non-roundness conforming to the requirement, to solve the technical bottlenecks that in the pipe thread rolling, especially welded pipe and thin-walled pipe, where it is easy to increase the non-roundness and deformation resulting in rolling failure, and greatly relax the hollow blank non-roundness applicability. It is not only applied to the existing hollow blank with seams and seamless, thick and thin walled, but also to relatively soft copper or aluminum alloy pipes with a variety of wall thickness and other types of metal hollow blank. Through the scientific calculation of the outer diameter tolerance, the yield strength, the elastic modulus and the elastic-plastic deformation force of the external thread of the hollow blank, the radial position and taper of the pre-forming rolling wheel, rolling number and time, the number of rolling wheel and the length of the spiral line, the residual stress of the blank and the elastic deformation and the required rolling pressure, are reasonably controlled, together with the number, form and rolling type of pipe thread forming rolling wheel, so as to simplify the rolling apparatus, and the final rolling external pipe thread products has more than 90% pass rate, greatly enhancing the practicality of rolling pipe thread technology.

The invention has the beneficial effects of greatly relaxing the requirement of non-roundness of the ordinary steel pipe (hollow cylindrical blank) accounting for 95% of the market by the rolling pipe external thread process, simplifying the rolling apparatus and realizing the basically the same processing steps as that threading machine used 100% for the current pipe external thread processing. At the same time, compared with the existing external pipe thread products, the product stress distribution more reasonable and better quality. The foregoing objects, technical solutions and beneficial effects of the present invention will be described in detail below with reference to the accompanying drawings and specific embodiments.

DESCRIPTION OF FIGURES

FIG. 1*a* is a schematic view of a process of stamping perfect conical surface based on the existing rolling external pipe thread technology.

FIG. 1*b* is a schematic view of a process of cutting the perfect conical surface based on the existing rolling pipe thread technology.

FIG. 1*c* is a process diagram showing the process of axial rolling external pipe thread after stamping or cutting the conical surface in FIGS. 1*a* and 1*b*.

FIG. 2*a* is a schematic view of the rolling process for pre-forming cylindrical surface.

FIG. 2*b* is a schematic view of the rolling process for pre-forming conical surface.

FIG. 3*a* is a schematic view of the rolling process for pre-forming cylindrical surface.

FIG. 3*b* is a schematic view of the rolling process for pre-forming conical surface.

FIG. 3*c* is a schematic view of the rolling process for pre-forming cylindrical and conical mixing surface.

FIG. 4*a* is a schematic view of a pre-forming rolling process for rolling to form a cylindrical surface according to the present invention.

FIG. 4*b* is a schematic view of a pre-forming rolling process for rolling to form a conical surface according to the present invention.

FIG. 4*c* is a schematic view of a pre-forming rolling process for rolling to form a cylindrical conical mixing surface according to the present invention.

FIG. 5*a* is a schematic view of a process for preparing to roll to form an external pipe thread on the hollow blank being rolled with a cylindrical surface.

FIG. 5*b* is a schematic view of a process for preparing to roll to form an external pipe thread on the hollow blank being rolled with a conical surface.

FIG. 5*c* is a schematic view of a process for preparing to roll to form an external pipe thread on the hollow blank being rolled with a cylindrical conical mixing surface.

FIG. 5*d* is a schematic view, which shows the state after performing the rolling pipe thread on the hollow blank in FIGS. 5*a*, 5*b* and 5*c*.

FIG. 6*a* is a schematic view of the distribution of the five rolling wheels of the pre-forming rolling head.

FIG. 6*b* is a schematic structural view of a rolling head with a rolling wheel disc only which is mounted with a smooth pre-forming rolling wheel.

FIG. 7*a* is a structure view of the conical pre-forming rolling wheel according to the present invention.

FIG. 7*b* is a schematic structure view of an integral pre-forming rolling wheel with a cylindrical surface according to the present invention.

FIG. 7*c* is a structural schematic view of a pre-forming rolling wheel and a cutting blade separately formed according to the present invention.

FIG. 7*d* is a schematic structural view of a pre-forming rolling wheel and a cutting blade formed with one body according to the present invention.

FIG. 8*a* is a schematic view of the distribution of the four rolling wheels of the rolling head for performing pipe thread.

FIG. 8*b* is a schematic structural view of a rolling head mounted with a rolling wheel for performing pipe thread and provided with an adjusting disc and a rolling wheel disc according to one embodiment.

FIG. 11*a* is a front view of the rolling wheel disc.

FIG. 11*b* is a side view of the rolling wheel disc.

FIG. 12*a* is a front view of the rolling wheel axle.

FIG. 12*b* is a top view of the rolling wheel axle.

FIG. 12*c* is a side view of the rolling wheel axle.

FIG. 12*d* is a schematic view, which shows that axis of the rolling wheel axle and axis of the hollow cylindrical blank have an angle δ in the vertical direction.

FIG. 14*a* is a front view of the rolling wheel disc.

FIG. 14*b* is a side view of the rolling wheel disc.

FIG. 15*a* is a front view of the adjusting disc.

FIG. 15*b* is a side view of the adjusting disc.

FIG. 16*a* is a front view of the rolling wheel axle.

FIG. 16*b* is a top view of the rolling wheel axle.

FIG. 16*c* is a side view of the rolling wheel axle.

FIG. 16*d* is a schematic view which shows that axis of the rolling wheel shaft and axis of the hollow cylindrical blank have an angle δ in the vertical direction.

FIG. 17*a* is a schematic view of the rolling wheel structure and its cooperation with the needle bearing according to the present invention.

FIG. 17*b* is a schematic view showing cooperation of the rolling wheel, the needle bearing and the rolling wheel axle according to the present invention.

FIG. 17*c* is a cross-sectional view of a rolling wheel seat (sliding piece) mated to a rolling wheel axle.

FIG. 23*a* is a front view of the rolling processing module.

FIG. 23*b* is a top view of the rolling processing module.

FIG. 25*a* is a front view of the rolling processing module.

FIG. 25*b* is a top view of the rolling processing module.

FIG. 26*a* is a front view of the rolling apparatus.

FIG. 26*b* is a top view of the rolling apparatus.

FIG. 27*a* is a front view of the rolling processing module.

FIG. 27*b* is a top view of the rolling processing module.

FIG. 30*a* is a front view of the rolling processing module.

FIG. 30*b* is a top view of the rolling processing module.

LIST OF REFERENCE NUMBERS

Figure 1:
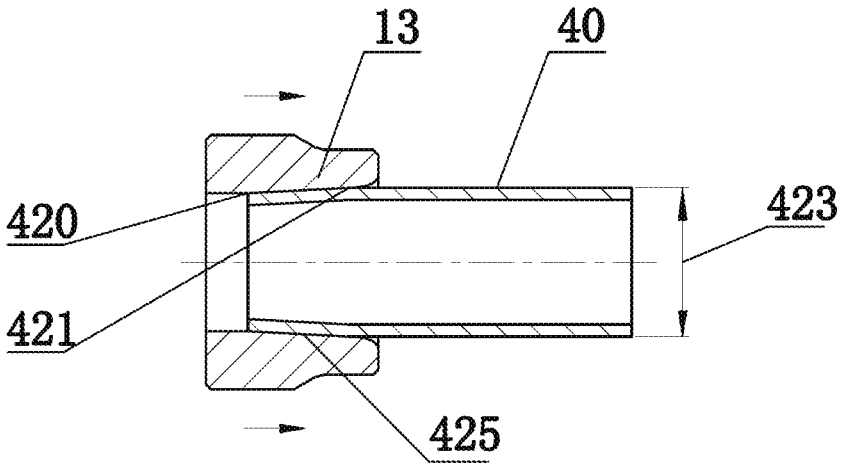
FIG. 1 shows a prior art for rolling external pipe thread.
Figure 1:
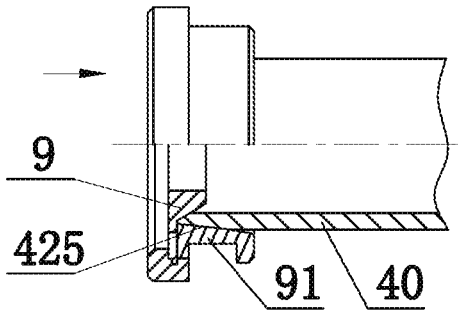
Figure 1:
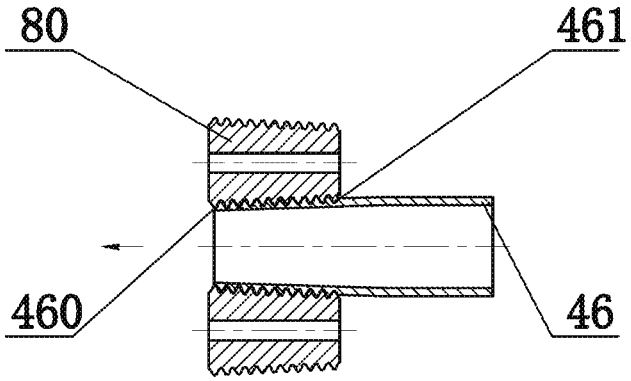

1 Seat and seat frame, 2 Power motor and transmission device, 20 Motor switch, 21 Transmission device, 22 Power motor, 23 Hollow spindle, 3 Workpiece clamping device, 31 Shaft hole connected to the seat, 4 Hollow blank and pipe thread products, 40 Original hollow blank, 400 Processing starting end, 401 Processing ending end, 403 Original hollow cylindrical outer diameter, 42 Hollow blank after pre-preparation process, 420 Processing starting end, 421 Processing ending end, 422 Cylindrical blank inner diameter, 423 Cylindrical blank outer diameter, 424 Cylindrical surface of the cylindrical blank, 425 Conical surface of the cylindrical blank, 426 Conical blank short diameter, 46 Pipe thread product using rolling technology, 460 Threaded head, 461 Threaded tail, 48 Pipe thread product of the present invention, 480 Thread head, 481 Thread tail, 5 Rolling cutting device, 51 Rolling blade, 6 First pre-forming rolling head, 60 Rolling head, 60 Pre-forming rolling head, 60A A first (front) pre-forming rolling wheel disc or upper rolling head seat, 60A1 Upper rolling head seat pushrod, 60A2 Upper rolling head seat plate, 60B Second (rear) pre-forming rolling wheel disc or Lower rolling head seat, 60B2 Rolling down rolling wheel seat plate, 601 Pin hole, 602 pin, 604 Workpiece work hole, 61 Radial groove, 611 Guiding column, 631 Worm, 6311 Pre-forming rolling head worm, 6312 Rolling head worm for pipe thread, 636 Worm gear, 64 Controlling rod, 66 Pre-forming adjusting disc, 66A First (front) pre-forming adjusting disc, 66B Second (rear) pre-forming adjusting disc, 661 pin, 662 Arc-shaped slot, 67 key pin, 68 Rolling head frame, 69 Torque amplification gear group, 691 Rotation handle, 696 Screw nut, 7 Rolling head for forming pipe thread, 70 Rolling wheel disc for forming pipe thread, 70A First (external pipe thread) rolling wheel disc, 70B Second (external pipe thread) rolling wheel disk, 701 Pin hole, 702 Pin, 703 Inclined plane, 704 Working hole, 71 Rolling wheel radial groove, 736 Worm gear, 75 Rolling head seat, 76 External pipe thread adjusting disc, 761 Pin hole, 762 Arc-shaped slot, 763 Pin, 764 Working hole, 766 Mounting blind hole, 77 Key pin, 8 Rolling wheel, 80 Rolling wheel in existing rolling pipe thread technology,

81 Pre-forming rolling wheel of the present invention, 82 Rolling wheel for forming pipe thread of the present invention, 821 First rolling wheel thread starting portion of four annular rolling wheels, 822 Second rolling wheel thread starting portion of four annular rolling wheels, 823 Third rolling wheel thread starting portion of four annular rolling wheels, 824 Fourth rolling wheel thread starting portion of four annular rolling wheels, 83 Rolling wheel axle of the present invention, 831 Needle bearing of the rolling wheel axle, 832 Inclined plane on end of rolling wheel axle, 832*a* Narrow inclined plane on end of rolling wheel axle, 832*b* Large inclined plane on end of rolling wheel shaft, 833 Cylindrical end on port of rolling wheel axle, 836 Sliding piece on end of rolling wheel axle, 86 Rolling wheel seat of the present invention, 891 Axial clearance, 892 Radial clearance, 9 Chamfering device (or processing tool of end surface), 91 Cutting blade, 936 Worm gear, 95 Rolling head seat, 10 Sliding seat, 101 Crank of sliding seat, 102 Main sliding seat (right and left sliding seat), 103 Sub-sliding seat (front and rear sliding seat), 11 (Two) axial guiding posts or plane guiding rails on the seat, 111 Horizontal left and right plan guiding rails, 112 Horizontal front and rear plan guiding rails, 12 Photoelectric sensing devices, 121 (Photoelectric sensing) control adjusting contacting rod 1, 122 (Photoelectric sensing) control adjusting contacting rod 2, 123 relative rotation angle position detecting device (Bias codec), 13 Taper punching die, 14 Inner bore processing tool, 1436 Worm gear, 145 Inner bore processing tool seat 15, End working tool, 1536 Worm gear, δ Deflection angle of rolling wheel shaft and work piece in vertical direction, X Center line of rolling wheel axle, X' Center line of hollow blanket

DETAILED DESCRIPTION OF EMBODIMENTS

The following is the detailed description of the invention in combination of preferred embodiments. It should be noted that despite of the fact that all terms used are selected from those known to the public according to description thereafter, some terms are selected by the applicant at its discretion, of which implications are to be interpreted according to the principle as revealed by the invention. Orientation terms such as "upper", "lower", "left", "right", "front", "rear", "horizontal", "perpendicular" as used herein is only for description other than limitation on orientation of various devices and parts used.

Term Description

Term "odd-even different" refers to in any two rolling wheel groups that are connected one after another in the processing order, when the number of rolling wheels contained in one rolling wheel group is an odd number, the number of rolling wheels contained in the other rolling wheel group is an even number.

Non-roundness: there is a phenomenon that the outer diameters are not equal in the cross-section of the circular steel pipe, that is, the maximum outer diameter and the minimum outer diameter are not mutually perpendicular to each other, that is, the absolute value of the difference between the maximum outer diameter and the minimum outer diameter is not-roundness. Due to the presence of non-roundness, the steel pipe (hollow blank) is of actually an irregular polygon.

The term "inclined plane" refers to a plane that has an included angle (spiral rising angle) with the reference horizontal plane from the axis of the rolling wheel.

The two lines (assumed to be a-line and b-line) of the present invention have angles in the "vertical direction". It can be understood that in the XYZ three-dimensional coordinate system, the plane parallel to the a-line and the b-line is defined as XY plane, then the angle formed between the two lines (the a'-line and the b'-line) when the a-line and the b-line are projected along the Z axis in the XY plane is the angle that the a-line and the b-line exist in the "vertical direction". For example, the axis of the rolling wheel and the axis of the hollow blank to be processed have a deflection angle of not more than 9 degrees in the vertical direction. It can be understood that in the XYZ three-dimensional coordinate system, the plane parallel to the axis of the rolling wheel and the axis of the hollow blank to be processed is defined as the XY plane. The angle formed between the two lines of the axis of the rolling wheel and the axis of the hollow blank to be processed being projected along the Z axis in the XY plane is not more than 9 degrees in the XYZ three-dimensional coordinate system.

Thread length accuracy: tightly screw the standard ring gauge and pipe threads to be tested, and examine the parallelism of the thread port and the first, second or third step plane of the ring gauge, wherein being parallel with the second step it is standard thread length accuracy, parallel with the first step it is upper limit of the standard thread length accuracy, and parallel with the third step it is the lower limit of the standard thread length accuracy.

Hollow blanks according to the present invention refers to hollow blanks that can be cold formed, including not only metal pipes such as steel pipes, aluminum pipes and copper pipes, but also metal workpieces having a hollow tubular portion structure such as the pipe joint, tee, and it is also possible to include other plastic pipes or workpieces of similar shape that can be cold formed.

The pre-forming rolling according to the present invention refers to the rolling process of rolling out the cylindrical or conical or cylindrical conical mixing surface on the hollow blank by the rolling wheel.

The pipe thread forming rolling according to the present invention refers to the rolling process of rolling out a cylindrical or conical pipe thread on a pre-formed hollow blank by a rolling wheel.

In the present invention, for the convenience of description in some cases, the rolling process by the "first rolling wheel group" or the "first rolling head" is also referred to as "pre-forming rolling" or the "first rolling wheel group" is referred to as a "pre-forming rolling wheel group" and a "first rolling head" is referred to as a "pre-forming rolling head", and the rolling process by the "second rolling wheel group" or "second rolling head" is referred to as "pipe thread forming rolling", or "second rolling wheel group" is referred to as "pipe thread forming rolling wheel group" and "second rolling head" is referred to as "pipe thread forming rolling head". However, this description is not intended to limit the function of the "first rolling wheel group" or the "first rolling head" to merely correcting or pre-forming, and does not mean that only "second rolling wheel group" or "second rolling head" can achieve or obtain the technical effects described in the present invention.

The structure of the pre-forming rolling head of the present invention may be the same as or similar to the structure of the pipe thread rolling head of the present invention.

The concept that the rolling head of the present invention rotates while the hollow blank does not rotate or the rolling head of the present invention does not rotate but the hollow blank rotates is relative to each other and is also switchable or both rotate with each other.

The rolling wheel group according to the present invention refers to a combination of a plurality of rolling wheels used in the same rolling process. The specific setting methods of these rolling wheels in the rolling process can be set by techniques well known to those skilled in the art (for example "Thread Processing", edited by Wang Xiangkui, Mechanical Industry Press, 2008). Therefore, the method of the present invention is not limited to a certain specific rolling apparatus.

The rolling head according to the present invention refers to a device for rolling on a hollow blank to form an intermediate blank and pipe thread products suitable for further processing of the external pipe thread. Main body of the device comprises several rolling wheels for rolling pipe thread and rolling wheel seats for supporting or fixing the rolling wheel. The rolling wheel cooperates with the rolling wheel seat through a rolling wheel axle and is equal distributed in a radial direction about the hollow blank. In a specific case, a plurality of rolling wheel seats is integrally formed in the same wheel structure to form a rolling wheel disc.

The rolling process module of the present invention refers to a combination of a plurality of rolling heads or a combination of a plurality of rolling heads and other processing tools. Each rolling head may be completely independent or may be disposed in an integral structure. Said other processing tools include taper cutting tool, the correction tool for the inner chamber of blank, the chamfering cutting tools inside and outside end port, and thread surface processing tools.

In the present invention, the term "rolling along axial radial mixing direction" or "axially radially hybrid rolling" means that the relative movement between the rolling wheel and the blank during the rolling process includes the axial and radial directions movement at the same time, and the relative movement is the relative axial movement of the rolling wheel and the hollow cylindrical blank caused by the axial component, which is generated by the spiral rising angle of the rolling wheel with respect to the hollow blank or the deviation angle in vertical deflection between the axis of the rolling wheel and the axis of the hollow cylindrical blank when the rolling wheel is engaged with and rotated relative to the hollow cylindrical blank, while the rolling wheel is radial fed according to certain process requirements to complete the rolling process. When the relative movement speed in the radial direction is zero, i.e. it is the "rolling in the axial direction" or the "axially rolling" described. When the relative movement speed in the axial direction is zero, i.e. it is the "rolling in radial direction" or "radial rolling" described. Therefore, the axial rolling and radial rolling are special cases of axial radial mixing rolling. Actual methods for implementing axial rolling and radial rolling can be various and are described in detail below with reference to the accompanying drawings. It should be noted that the following description is not intended to limit the scope of the present invention.

The "cylindrical conical mixing surface" according to the present invention refers to the outer surface of the hollow blank comprising both the cylindrical surface and the conical surface, or it can be understood as the outer surface composed of one or more cylindrical surfaces and one or more conical surfaces.

The "inner side of the hollow blank" and the "end of the hollow blank" described in the present invention can be understood as the position corresponding to the thread tail and the thread head in the portion to be processed with external pipe thread. Completing the axial rolling from the inner side of the hollow blank to the end of the hollow blank can be understood as completing the axial rolling from the corresponding position of the thread tail to the corresponding position of the thread head. Pre-rolling in the axial radial mixing direction using this method may be referenced to the rolling method of the external pipe thread shown in the patent WO2014161447A1.

In part, the present invention generally provides the following technical solutions:

1. A rolling method for forming an external pipe thread, comprising rolling a hollow blank by a first rolling wheel group and a second rolling wheel group in turn, wherein the first rolling wheel group comprises at least four circumferentially arranged first rolling wheels, and the second rolling wheel group comprises at least three circumferentially arranged second rolling wheels, the first rolling wheels are rolling wheels with smooth outer surface, and the second rolling wheels have external pipe thread forming portion, and the rolling method includes the following steps:

step 1: the first rolling wheel group rolls the outer surface of the hollow blank into a cylindrical surface, a conical surface, or a cylindrical conical mixing surface;

step 2: the second rolling wheel group rolls the outer surface of the hollow blank processed in the step 1 again, so as to form the external pipe thread by rolling; wherein the number of the first rolling wheels in the first rolling wheel group and number of the second rolling wheels in the second rolling wheel group is odd-even different.

2. The rolling method for forming an external pipe thread of aspect 1, wherein the number of the first rolling wheels in the first rolling wheel group is greater than the number of the second rolling wheels in the second rolling wheel group.

3. The rolling method for forming an external pipe thread of aspect 1, wherein the method is used to process a conical external pipe thread, and the external port diameter of the cylindrical surface or conical surface or the cylindrical conical mixing surface is preferably the port median diameter of the conical external pipe thread plus 5%-90% of the tooth height of the conical external pipe thread, preferably the port median diameter of the conical external pipe thread plus 15%-85% of the tooth height of the conical external pipe thread.

4. The rolling method for forming an external pipe thread of aspect 1, wherein the method is used to process cylindrical external pipe thread, and the external port diameter of the cylindrical surface or the conical surface or the cylindrical conical mixing surface is the port median diameter of the cylindrical external pipe thread plus 5%-90% of the tooth height of the cylindrical external pipe thread, preferably the port median diameter of the cylindrical external pipe thread plus 20%-85% of the tooth height of the cylindrical external pipe thread.

5. The rolling method for forming an external pipe thread of aspect 1, wherein the method is used to process the conical external pipe thread, and the first rolling wheel group rolls the outer surface of the portion of the hollow blank to process thread into a cone surface, and the taper of the cone surface is 2°-5°, preferably 2°30"-4°30".

6. The rolling method for forming an external pipe thread of aspect 3, wherein the axial length of the cylindrical surface or the conical surface or the cylindrical conical mixing surface is greater than or equal to the axial length of the external pipe thread to be processed; preferably 1 to 3 pitches greater, particularly preferably 2 pitches greater.

7. The Rolling Method for Forming an External Pipe Thread of Aspect 3, Wherein the First Rolling Wheel has One or More of the Following Features:

a) the first rolling wheel is a cylindrical or conical rolling wheel with a smooth outer surface;

b) there is a deflection angle of not more than 9 degrees in the vertical direction between the axis of the first rolling wheels and the axis of the hollow blank to be processed;

c) there is a free-play clearance between the first rolling wheel and the rolling wheel seat on which it is located.

Preferably, the first rolling wheel is a conical rolling wheel with a smooth outer surface, and the axis thereof has a deflection angle of not more than 9 degrees in the vertical direction with respect to the axis of the hollow blank to be processed.

8. The rolling method of aspect 1, wherein the rolling process of the first rolling wheel group and the second rolling wheel group is selected from one of the following combinations:

a, both the rolling process of the first rolling wheel group and the rolling process of the second rolling wheel group are axial rolling;

b, the rolling process of the first rolling wheel group is radial rolling, and the rolling process of the second rolling wheel group is axial rolling;

c, the rolling process of the first rolling wheel group is axial radial mixing rolling, and the rolling process of the second rolling wheel group is axial rolling.

9. The rolling method of aspect 1, wherein the hollow blank has non-roundness greater than 100 um.

10. The rolling method of aspect 1, wherein the rolling method is used to process external pipe threads on a hollow blank having a size of 2 inches or less, and both the number of the first rolling wheels in the first rolling wheel group and the number of the second rolling wheels in the second rolling wheel group is no more than 15, preferably 4, 5, 6, 7, 8, or 9;

or the method is used to process an external pipe thread on a hollow blank having a size between 2 and 4 inches, and both the number of the first rolling wheels in the first rolling wheel group and the second rolling wheels in the second rolling wheel group is no more than 19, preferably 4, 5, 6, 7, 8, 9, 10, or 11;

or the method is used to process an external pipe thread on a hollow blank having a size of 4 inches or more, and both the number of the first rolling wheels in the first rolling wheel group and the number of the second rolling wheels in the second rolling wheel group is no more than 35, preferably 4, 5, 6, 7, 8, 9, 10, 11, 12, 13, 14, 15, 16, 17, 18, 19 or 20.

11. The rolling method of aspect 1, wherein the number of the first rolling wheels in the first rolling wheel group is different from the number of the second rolling wheels in the second rolling wheel group by 1 to 11, more preferably by 1, 3, 5 or 7.

12. The rolling method of aspect 1, wherein the number of the first rolling wheels in the first rolling wheel group is four and the number of the second rolling wheels in the second rolling wheel group is three;

or the number of the first rolling wheels in the first rolling wheel group is five and the number of the second rolling wheels in the second rolling wheel group is four;

or the number of the first rolling wheels in the first rolling wheel group is six, and the number of the second rolling wheels in the second rolling wheel group is five.

13. A rolling method for forming an external pipe thread, wherein the method is to perform thread forming rolling process on the outer surface of the pre-forming rolled hollow blank, wherein the pre-forming rolling refers to the process of rolling the outer surface of the hollow blank into a cylindrical or a conical surface or a cylindrical conical mixing surface by the first rolling wheel group, and the first rolling wheel group comprises at least four circumferentially arranged first rolling wheels with smooth outer surface, and the thread forming rolling is performed by the second rolling wheel group including at least three circumferentially arranged second rolling wheels having a external pipe thread forming portion, and wherein the number of the first rolling wheels in the first rolling wheel group and the number of the second rolling wheels in the second rolling wheel group is odd-even different.

14. A rolling head comprising at least three circumferentially arranged rolling wheels (8), a first rolling wheel disk (70A), a second rolling wheel disc (70B) and a connecting pin (702), wherein the first rolling wheel disc and the second rolling wheel disc are provided with radial grooves (71), workpiece working holes (704) and pin holes (701), corresponding to each other, and the rolling wheel (8) cooperates with the radial grooves (71) on the first and second rolling wheel discs via its rolling wheel axle (83)_, and mounting surfaces of the radial grooves (71) for the rolling wheel (8) is an inclined plane (703); the first rolling wheel disc and the second rolling wheel disc are connected and fixed with each other through the connecting pins (702) cooperating with the pin holes (701) to form a rolling head coaxially, and the rolling wheel axles (83) respectively have inclined planes (832*a*, 832*b*) parallel to each other at two ends respectively; the rolling wheel axles (83) are mounted on the radial groove (71) of the rolling wheel disc through the inclined planes (832*a*, 832*b*), wherein the axis of the rolling wheel forms an included angle with the inclined plane (832*a*, 832*b*).

15. The rolling head of aspect 14, wherein the included angle is less than 9 degrees, preferably less than 3 degrees.

16. The rolling head of aspect 14, wherein the rolling head further comprises a first adjusting disc, a second adjusting disc and an adjusting disc pin (762), and the first adjusting disc and the second adjusting disc are provided with positioning and installing blind holes (766), arc-shaped grooves (762), workpiece working holes (764) and pin holes (761) corresponding to each other; the first adjusting disc and the second adjusting discs are respectively and coaxially mounted on the outer sides of the first rolling wheel disc and the second rolling wheel disc through the positioning and installing blind holes (766), and are mutually connected by the adjusting disc pin (762); both ends of the rolling wheel axle (83) also has an extension (833) on the outside of the inclined plane, the extension (833) of the rolling wheel axle being mounted in the arc-shaped grooves (762) in the adjusting disc, turning the adjusting disc can drive the rolling wheel axle (83) to slide in the arc-shaped grooves (762) so as to drive the rolling wheel axle (83) to move radially in the radial groove (71) of the rolling wheel disc (70).

17. The rolling head of aspect 16, wherein the rolling head further comprises a sliding piece, and the extension of the rolling wheel axle cooperates with a shaft hole of the sliding piece and is installed in the arc-shaped slot (762) of the adjusting disk through the sliding piece 836; rotating the adjusting disc (76) can drive the sliding piece to slide in the arc-shaped groove (762) to drive the rolling wheel axle (83) to move radially in the radial groove (71) of the rolling wheel disc (70).

18. The rolling head of aspect 16, wherein the rolling head further comprises a control adjusting rod (122) installed at the end of the rolling head on the side where rolling is completed; during the rolling process, when the hollow blank contacts the control adjusting rod (122), the control adjusting rod (122) can drive the photoelectric sensing device to work and control the rotation of the first adjusting disc and the second adjusting disc to control start and stop of the rolling process.

19. The rolling head of aspect 16, wherein the rolling head further comprises a mechanical plunger (121) mounted on the top or the bottom of the rolling head on the side where rolling is completed, and during rolling, when the hollow blank contacts the mechanical plunger (121), the mechanical plunger (121) can drive the photoelectric sensing device to work and control the rotation of the first adjusting disc and the second adjusting disc to control the start and stop of the rolling process.

19. The rolling head of aspect 16, wherein a relative rotational position angle detecting means (123) is provided between the first rolling wheel disc and the first adjusting disc or between the second rolling wheel disc and the second adjusting disc.

20. The rolling head of aspect 14, wherein the rolling wheel is a rolling wheel with a smooth outer surface and the rolling wheel has a cutting blade integrally formed with the rolling wheel.

21. The rolling head of aspect 14, wherein the rolling wheel is a conical rolling wheel with a smooth outer surface, and the taper of the conical rolling wheel is 2°-5°, preferably 2°30"-4°30".

22. The rolling head of aspect 14, wherein the rolling wheel is an annular rolling wheel and has a external pipe thread forming portion, and there is a deflection angle of not more than 9 degrees between the axis of the rolling wheel and the axis of the workpiece working hole in the vertical direction, and there is also an initial part of the thread on the surface of the rolling wheel, and the initial part of the thread refers to the thread that the annular rolling wheel in the thread rolling process firstly contacts with the hollow blank and meets the following conditions:

a total of N annular rolling wheels are arranged in the second rolling head, and starting from one of the annular rolling wheels $R_i$, the initial part of the next rolling wheel $R_{i+1}$ along the same clockwise direction is the thread obtained based on the initial partial thread of the rolling wheel $R_i$ and extending a distance of 1/N pitch according to the original thread profile and pitch in the direction of the rolling wheel Ri axis.

23. A rolling head comprising at least three circumferentially arranged rolling wheels (8) and rolling wheel seats, wherein the rolling head further comprises an upper rolling wheel seat plate (60A2), a threaded upper rolling wheel seat pushrod (60A1), a torque amplification gear group (69), a screw nut 696, a rotation handle 691; the upper rolling wheel seat plate 60A2 is fixedly connected to the upper rolling wheel seat 60A and sleeved on the guide column 61 to form a shaft hole fitting; one end of the upper rolling wheel seat pushrod 60A1 fixedly abuts on the upper rolling wheel seat disc 60A2, and the other end is matched with the screw nut 696 and coaxially matched with the inner hole of output gear bearing in the torque amplification gear group, and the input shaft of the torque amplification gear group 69 is fixedly connected with the rotation handle 691, and the lower rolling wheel seat plate 60B2 is fixedly connected to the lower rolling wheel seat (60B) and sleeved on the guide column 61 to be fixed; the upper rolling wheel seat pushrod 60A1 is driven to move up and down through the torque amplifying gear group 69 and the screw nut 696 when the rotation handle 691 drives the gear input shaft to rotate; when the hollow cylindrical blank 40 is snapped and rotated by the rolling wheel 81, radial feed rolling of the rolling wheel is completed.

24. A process module for rolling an external pipe thread, comprising a first rolling head and a second rolling head, wherein the first rolling head comprises at least four circumferentially arranged first rolling wheels; the first rolling wheel is a rolling wheel with a smooth outer surface; and the second rolling head comprises at least three circumferentially arranged second rolling wheels having an external pipe thread forming portion; and the number of the first rolling wheels in the first rolling wheel group and number of the second rolling wheels in the second rolling wheel group is odd-even different.

25. The process module of aspect 24, wherein the number of the first rolling wheels in the first rolling wheel group is greater than the number of the second rolling wheels in the second rolling wheel group.

26. The process module of aspect 24, wherein the first rolling wheel is a conical rolling wheel with a smooth outer surface, and the taper of the conical rolling wheel is 2°-5°, preferably 2°30"-4°30".

27. The process module of aspect 24, wherein the first rolling head and the second rolling head which are combined into one body and the first rolling head and the second rolling head are arranged coaxially with the hollow blank to be processed, wherein the first rolling head is arranged on the side close to the start of the external pipe thread processing.

28. The process module for rolling an external pipe thread of aspect 27, wherein the first rolling head comprises a corresponding first rolling wheel disc, a second rolling wheel disc and a connecting pin, and the first rolling wheel disc and the second rolling wheel disc are provided with radial grooves, workpiece processing holes and pin holes corresponding to each other, and the rolling wheel cooperates with the radial grooves on the first rolling wheel disc and the second rolling wheel disc via the rolling wheel axle, and mounting surface of the radial groove (71) and the rolling wheel (8) is an inclined plane (703); the first rolling wheel disc and the second rolling wheel disc are fixedly connected to each other by a connecting pin matched with the pin hole, coaxially formed as the rolling head, and two ends of the rolling wheel axle (83) is provided with inclined planes (832*a*, 832*b*) parallel to each other and the rolling wheel axle (83) is mounted on a radial groove (71) of the rolling wheel disc through the inclined planes (832*a*, 832*b*); the axis of the rolling wheel forms an included angle with the inclined planes (832*a*, 832*b*), and the included angle is less than 9 degrees, preferably less than 3 degrees, and the first rolling head further comprises a mechanical plunger; the mechanical plunger is installed on the top or the tail of the rolling head on the side where the rolling is finished;

And the second rolling head also comprises a corresponding first rolling wheel disk, a second rolling wheel disk and a connecting pin; the first rolling wheel disk and the second rolling wheel disk are provided with radial grooves, workpiece processing holes, and pin holes corresponding to each other; the rolling wheel cooperates with the radial grooves on the first rolling wheel disc and the second rolling wheel disc via its rolling wheel axle; the first rolling wheel disc and the second rolling wheel disc are fixedly connected to each other by a connecting pin matched with the pin hole, coaxially formed as the rolling head; the second rolling head further comprises a control adjusting rod; the control adjusting rod is installed on the end of the second rolling head on the side where the rolling is finished.

The first rolling head and the second rolling head are coaxially arranged together by a pin.

29. The process module for rolling an external pipe thread of aspect 28, wherein the first rolling head further comprises a corresponding first adjusting disc, a second adjusting disc and a adjusting disc pin; the first adjusting disc and the second adjusting disc are provided with positioning and installing blind holes, arc-shaped grooves, workpiece processing holes and pin holes corresponding to each other; the first adjusting disc and the second adjusting disc are respectively and coaxially mounted on the outer sides of the first rolling wheel disc and the second rolling wheel disc through the positioning and installing blind holes and are mutually connected by the adjusting disc pin; both ends of the rolling wheel axle further have an extension on the outer side of the inclined plane, and the extension of the rolling wheel axle is installed in the arc-shaped groove of the adjusting disc; rotating the adjusting disc can drive the rolling wheel axle to slide in the arc-shaped groove so as to drive the rolling wheel axle to move radially in the radial groove of the rolling wheel disc;

and the second rolling head further comprises a corresponding first adjusting disc, a second adjusting disc and a adjusting disc pin; the first adjusting disc and the second adjusting disc are provided with positioning and installing blind holes, arc-shaped grooves, workpiece processing holes and pin holes corresponding to each other; the first adjusting disc and the second adjusting disc are respectively and coaxially mounted on the outer sides of the first rolling wheel disc and the second rolling wheel disc through the positioning and installing blind holes and are mutually connected by the adjusting disc pin; both ends of the rolling wheel axle further have an extension on the outer side of the inclined plane, and the extension of the rolling wheel axle is installed in the arc-shaped groove of the adjusting disc; rotating the adjusting disc can drive the rolling wheel axle to slide in the arc-shaped groove so as to drive the rolling wheel axle to move radially in the radial groove of the rolling wheel disc.

30. The process module for rolling an external pipe thread of aspect 24, wherein the module further comprises a first rolling head seat, a second rolling head seat, a transmission device and a power motor, and the first rolling head seat is fixedly mounted with the first rolling head, and the second rolling head seat is fixedly mounted with the second rolling head; an input main shaft of the transmission device is mechanically matched with the output main shaft of the power motor, and the output main shaft of the transmission device forms a mechanical cooperation with the first rolling head seat and the second rolling head seat; the power motor may drive the first rolling head seat and the second rolling head seat to rotate through the transmission device, so as to rotate the first rolling head and the second rolling head.

31. The process module for rolling an external pipe thread of aspect 30, wherein the mechanical cooperation between the output main shaft of the transmission device and the first rolling head seat and the second rolling head seat is a cooperation of a worm and a worm gear, and one end of the worm is mechanically matched with the output shaft of the transmission device, and the other end of the worm is matched with a first worm gear and a second worm gear, and the centers of the first worm gear and the second worm gear are respectively provided on the first rolling head seat and the second rolling head seat.

32. The process module for rolling an external pipe thread of aspect 31, wherein the module further comprises at least one third worm gear and a processing tool head seat mounted on the third worm gear, and the processing tool head seat is matched with one of a taper cutting tool, a correction tool for the inner hole of blank, a port surface processing tool and a thread surface processing tool through cooperation of key and groove.

33. The rolling process module for forming an external pipe thread of any one of aspects 30-32, wherein end of rolling wheel of any one or more of the first rolling head or the second rolling head is provided with a photoelectric sensing device for controlling the operation of the power motor.

34. A rolling apparatus for forming external pipe thread, wherein the apparatus comprises at least any one of the rolling head of aspects 14-22.

35. A rolling apparatus for forming external pipe thread, wherein the apparatus comprises the rolling head of aspect 23.

36. A rolling apparatus for forming external pipe thread, wherein the apparatus comprises at least any one of the process module of aspects 24-33.

37. A production line for external pipe thread comprises at least one of the rolling process modules of aspects 24-26, and the first rolling head and the second rolling head are respectively mounted on independent rolling devices thereof; the first rolling head and the second rolling head are used to roll the hollow blank in turn.

The following is detailed description with reference to the accompanying drawings:

1. Prior Art

FIG. 1 shows an existing rolling process schematic view. As shown in FIG. 1*a*, the hollow blank 40 is first axially instant punched into a conical surface 425 by a taper punching die 13 before performing the thread rolling. Alternatively, as shown in FIG. 1*b*, the cutting blade 91 in the axial cutting device 9 cuts the entire conical surface 425, and then use the rolling wheel 80 to perform thread rolling process of the hollow blank 46 containing the conical surface 425.

Process in FIG. 1*a* requires using taper mold machinery (or hydraulic) to axially move stamping workpiece. Firstly, it is processed to form a conical surface, and then the pipe thread are processed in the conical surface through rolling, otherwise, the pipe thread tooth is incomplete, and the body of the pipe is easy to crack.

There are at least the following three problems for the existing external pipe thread process in FIG. 1*a:*

1. As comparing with the current tapping process and cutting pipe external thread process, there is one more working procedure for processing the conical surface that requires huge apparatus, which is not only time-consuming, but also operation for pipe network site processing pipe external thread is very inconvenient, and thus cannot be acceptable.
2. Due to the huge axial instant stamping pressure, when the conical surface is formed, the pipe material, especially the weld pipe material, is easily damaged hidingly or obviously, which may cause the safety hazard of the pipe external thread product.

2, the Rolling Process for Forming Pipe Thread of the Present Invention

In a specific embodiment, the pipe thread forming rolling process of the present invention comprises two basic steps of pre-forming rolling and pipe thread forming rolling, that is, the pre-forming rolling is first performed on a hollow blank by using a pre-forming rolling wheel, and then thread forming rolling process is further performed by using the pipe thread forming rolling wheel on the hollow blank that its non-roundness, the outer diameter of the port, the taper and the axial length conforms with the subsequent rolling requirements, and during the process, the number of pre-forming rolling wheels and the number of pipe thread forming rolling wheels must be odd-even different.

Figure 2:
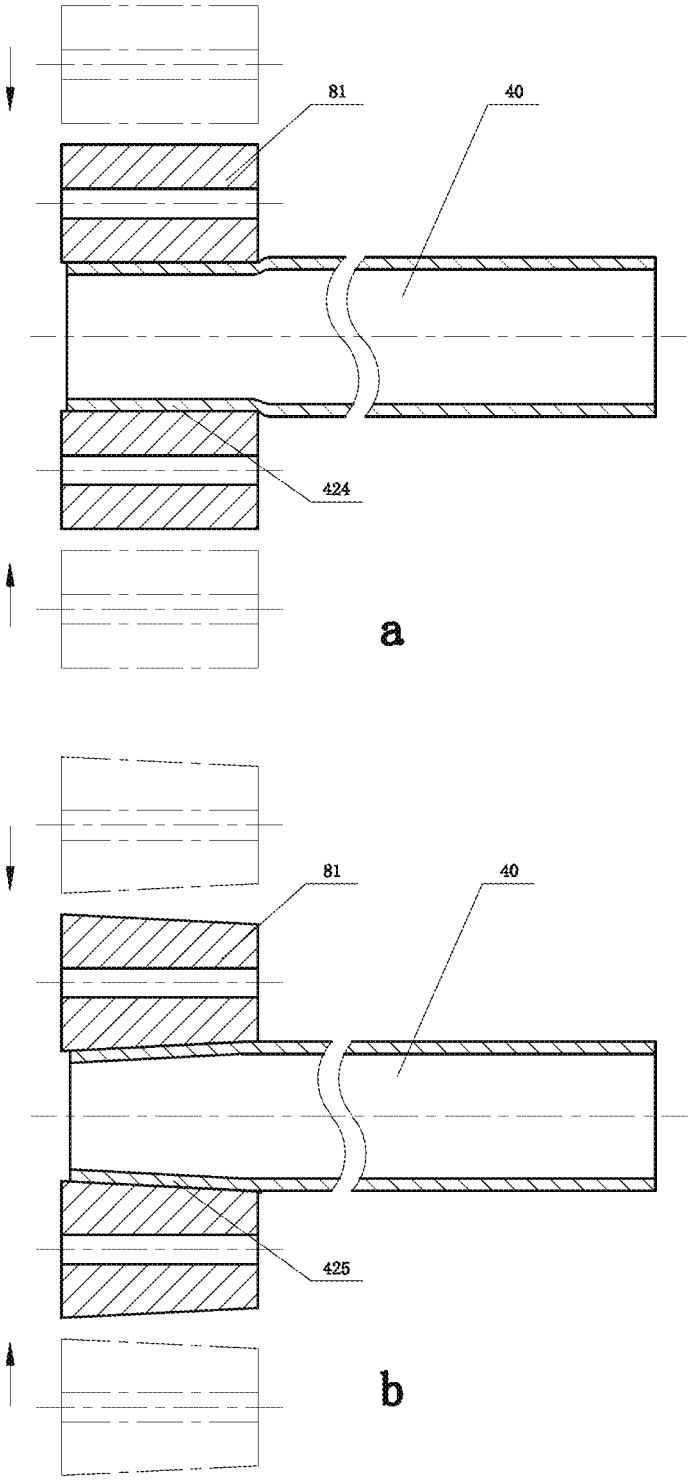
FIG. 2 is an embodiment of a radial pre-forming rolling process according to the present invention.
Figure 3:
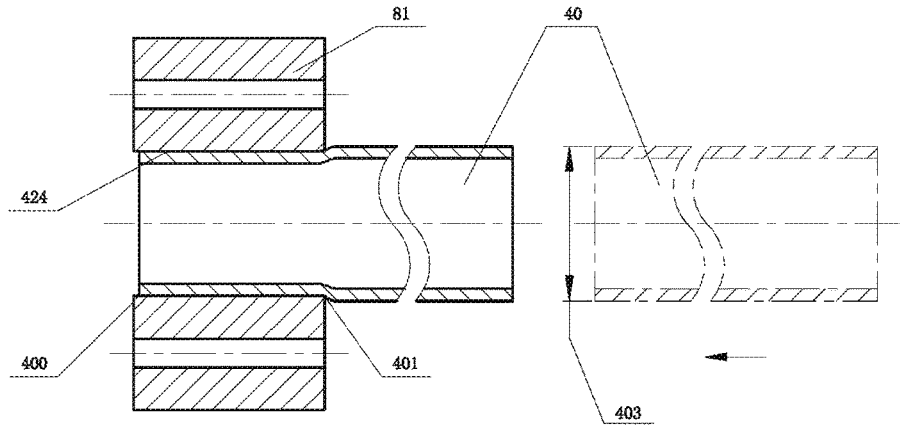
FIG. 3 is a schematic view of the rolling process for an axial pre-forming according to the present invention.
Figure 3:
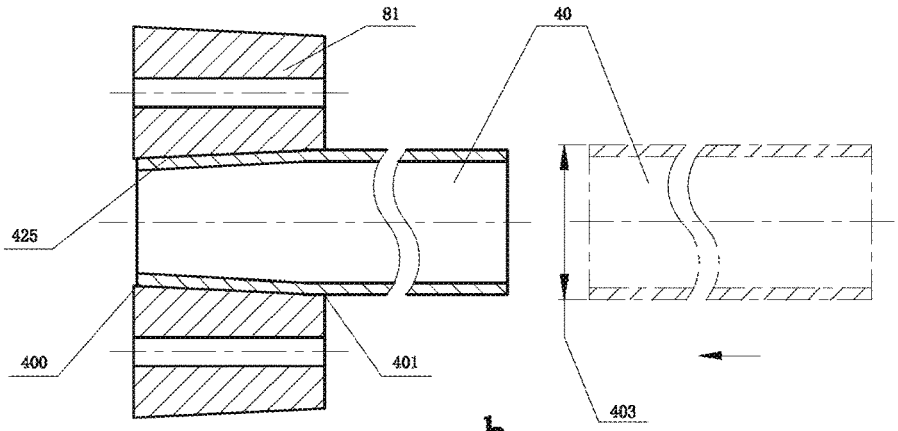
Figure 3:
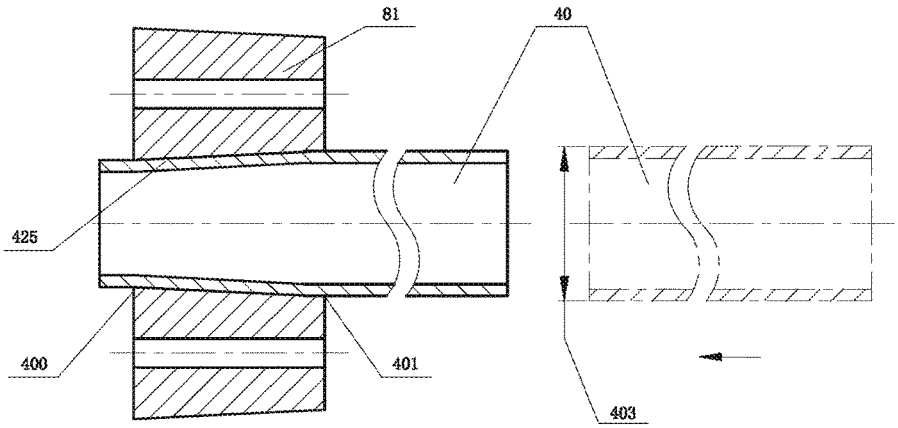
Figure 4:
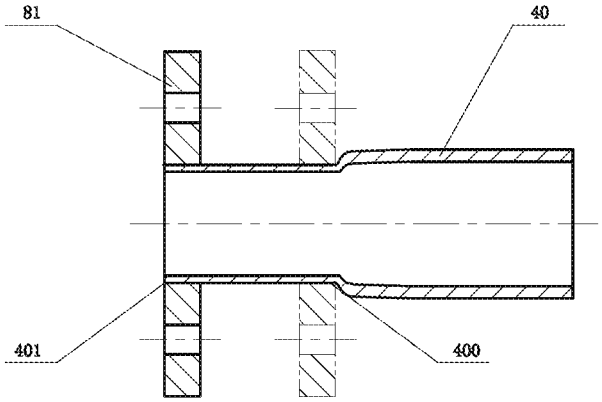
FIG. 4 is a schematic view of a pre-forming rolling process rolling in an axial and radial mixing direction according to the present invention.
Figure 4:
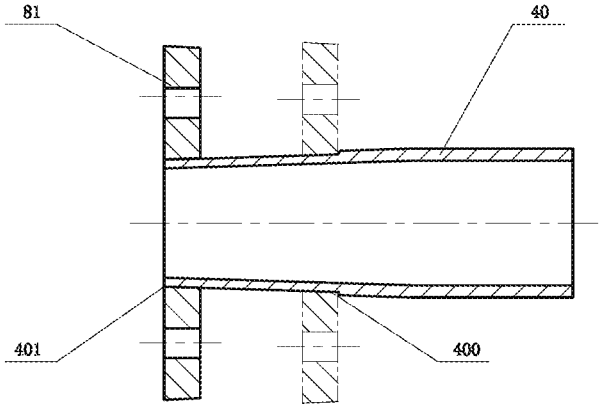
Figure 4:
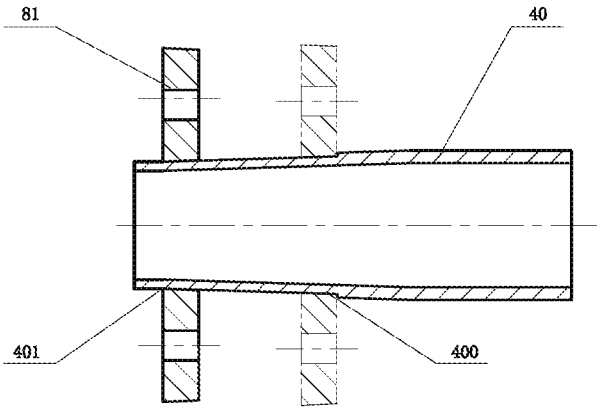

FIGS. 2 to 4 respectively show three pre-forming rolling process embodiments of the present invention.

FIG. 2 shows an embodiment of a radial pre-forming rolling process according to the present invention. As the hollow blank 40 is rotated, the rolling wheel 81 completes the pre-forming rolling of the cylindrical surface 424 (FIG. 2*a*) and the conical surface 425 (FIG. 2*b*) by gradually increasing the rolling pressure with radial feed. When the rolling wheel is designed as a conical cylinder mixture, the pre-formed hollow blank is also a conical cylinder mixture. Its rolling method and the existing radial rolling thread process is similar, which are not repeated here.

In order to reduce the radial rolling force of the apparatus, the pre-forming process of the present invention preferably adopts an axial pre-forming rolling process.

FIG. 3 shows an embodiment of the axial pre-forming rolling process of the present invention. As shown in FIG. 3*a*, the pre-forming rolling wheel 81 is a smooth cylindrical rolling wheel, and a radial offset angle is provided between the rolling wheel 81 and the hollow blank. During the pre-forming rolling process, at least four cylindrical rolling wheels perform cylindrical surface rolling on the outer surface of the hollow blank. The rolling of the cylindrical surface means that the outer surface of the rolled hollow blank is a cylindrical surface 424. As shown in FIG. 3*b*, when the pre-forming rolling wheel 81 is a conical smooth rolling wheel, at least four conical rolling wheels perform conical surface rolling on the outer surface of the hollow blank, and the conical rolling means the outer surface of the hollow blank is a conical surface 425. As shown in FIG. 3*c*, when the port of the hollow blank axially exceeds the conical rolling wheel 81, the exceeded portion is a cylindrical portion, and the pre-forming rolled hollow blank has a cylindrical conical mixing surface.

It should be noted that during the axially pre-forming rolling process of the present invention, the smooth pre-forming rolling wheel actually corresponds to a special annular rolling wheel whose tooth height is zero and pitch can be set. By setting the radial offset angle δ (as shown in FIG. 12*d* and FIG. 16*d*) between the smooth rolling wheel and the hollow blank, the smooth rolling wheel is changed into an annular rolling wheel with a certain pitch; the size of the pitch depends on value of the radial offset angle δ. The radial offset angle δ causes the axial relative movement between the hollow blank and rolling wheel when the hollow blank is in rotary contact with the rolling wheel at 400, completing the axial pre-forming rolling at 401, which changes a technical bias that the smooth rolling wheel only can be used for radial feed rolling. Due to the zero tooth height, the pressure deformation on the steel pipe is minimized when the hollow bland is fed in the axial direction by progressive automatic feeding.

In order to further reduce the radial rolling force of the apparatus and the subversion torque of the apparatus, an axial radial mixing pre-forming rolling process is preferably employed.

FIG. 4 shows an embodiment of an axial radial mixing pre-forming rolling process according to the present invention, in which the pre-forming rolling wheel 81 is a smooth cylindrical rolling wheel (FIG. 4*a*) or a conical rolling wheel (FIG. 4*b*), and the effective length of the rolling wheel is less than the thread length of the pipe external thread product to be processed. A radial offset angle is provided between the rolling wheel 81 and the hollow blank. The rolling wheel 81 moves axially from the inner side 400 of the hollow blank to the end 401 of the hollow blank, while the rolling wheel 81 is radially fed to a certain process position to remain unchanged or synchronously radial feed or synchronously radially fed to a certain process position to remain unchanged, so that outer surface of part of the hollow blank to be provided with thread were processed into a cylindrical surface (FIG. 4*a*) or a conical surface (FIG. 4*b*) or a cylindrical conical mixing surface (FIG. 4*c*).

The port outer diameter, taper and axial length of the formed cylindrical or conical or cylindrical conical mixing surfaces described in FIGS. 2, 3 and 4 can be provided as follows.

Port outer diameter: when used for rolling the cylindrical external pipe thread, the port outer diameter of the pre-formed blank is its corresponding median diameter of the cylindrical pipe external thread to be processed plus its tooth height by 5% to 90%, preferably by 20% to 85%.

When used for rolling conical external pipe thread, the port diameter of the pre-formed blank is equal to its corresponding median diameter of the conical pipe external thread to be processed plus its tooth height by 5%-90%, preferably plus its tooth height by 15% to 85%.

Taper: as a special case, the taper of the cylindrical surface formed by the pre-forming rolling is zero; the taper of the conical surface formed by the pre-forming rolling is generally from 2° to 5°, preferably from 2°30" to 4°30".

Axial length: it is to be noted that the length thereof after being pre-formed rolling should be greater than or equal to the length of the subsequent thread product, preferably 1 to 3 pitch greater.

More preferably, the port outer diameter, taper and axial length thereof are further optimized according to the outer diameter, wall thickness, material of the hollow blank and the like as well as pipe thread profile and the thread length accuracy to be rolled subsequently.

After the pre-forming rolling of the present invention, the stress of the blank section that is to be provided with the thread is partially released, and the non-roundness of the blank as well as the port diameter, taper and length (or height) of the cylindrical and conical surface reach the requirement of subsequent rolling pipe thread, which are more suitable for subsequent pipe thread forming rolling, and essential for the next step of the pipe thread forming rolling.

The shape of the pre-forming rolling wheel of the present invention is not limited to three types of cylindrical rolling wheel, conical rolling wheel and conical cylindrical mixing wheel. The cylindrical rolling wheel and the conical rolling wheel may not only be the rolling wheel with smooth outside surface, can also be the rolling wheel with a thread on outer surface.

When a rolling wheel with a thread is used, the thread profile and thread pitch of the rolling wheel must be adapted to the thread profile and thread pitch of the external pipe thread to be processed in the external pipe thread forming rolling step, and the thread may be a complete thread or an incomplete tread with a complete tooth bottom and an incomplete tooth top; shapes and combination of the rolling wheel may also be provided by referring to patent WO2014056419A1; the pre-forming rolling wheel can be an annular rolling wheel and can also be a spiral rolling wheel.

In an embodiment employing an annular rolling wheel, in order to be able to automatically feed the hollow blank in the pre-forming rolling step, the axis of the pre-forming rolling wheel has a certain deflection angle in vertical deviation from the axis of the hollow blank. The deflection angle is the same as the spiral rising angle of the pre-formed pipe thread.

In a more preferred embodiment, the pre-formed rolling wheel of the present invention utilizes a conical rolling wheel with a smooth surface, and in order to be able to automatically axial feed the hollow blank in the pre-forming rolling step, the axis of the pre-forming rolling wheel has a radial certain deflection angle in vertical deviation from the axis of the hollow blank. The larger the radial deflection angle is, the faster the axial feed rate of the hollow blank is, and the radial deflection angle is generally no more than 9 degrees. When the pre-forming rolling wheel is rotated relative to the hollow blank or the hollow blank is rotated relative to the pre-forming rolling head or both are rotated relative to each other, the axial feed for the pre-forming rolling is accomplished by an axial component incurred by the deflection angle.

The pre-forming rolling process of the invention can only use a group of pre-forming rolling wheels to perform pre-forming rolling of hollow blank, and can also use a plurality of groups of pre-forming rolling wheels to repeatedly perform pre-forming rolling of the hollow blank. After repeated pre-rolling, the hollow blank is processed with thread rolling in accordance with the spirit of the present invention, so as to form the external pipe thread.

Through the hollow blank processed by any pre-rolling process as shown in FIG. 2 to FIG. 4, in combination with the spirit of the matching of the odd and even numbers of the successively rolling head and rolling wheels and the total number of rolling wheels disclosed in this patent, and reasonably matching with the existing pipe thread processing technology to perform thread rolling, you can roll out the standard pipe thread products. The design and arrangement of the corresponding thread rolling wheel, as well as the design and arrangement of the thread rolling head, can take the solution described in the patent WO2014056419A1.

Figure 5:
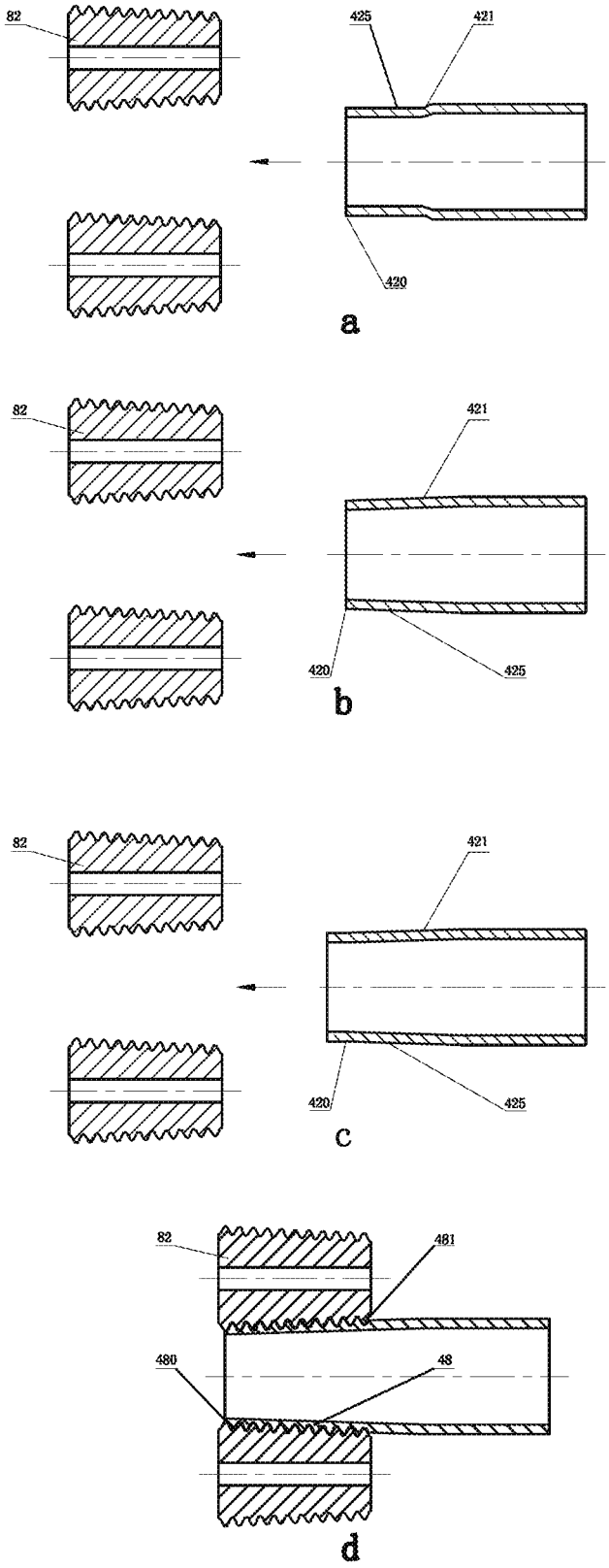
FIG. 5 is a schematic view of a process for forming an external pipe thread by axial rolling on the hollow blank after being pre-rolled in FIGS. 2, 3 and 4.

FIG. 5 is a schematic view of the process of the present invention for further axial rolling to form a pipe external thread on a pre-rolled hollow blank.

As shown in the figures, the pipe thread forming rolling wheel of the present invention comprises an external pipe thread forming portion through which a desired external pipe thread can be formed on a pre-rolled hollow blank by rolling.

In principle, the external pipe thread rolling process of the present invention can be understood as according to the outer diameter, the wall thickness and the material of the hollow blank, as well as the subsequent pipe thread profile and the thread length accuracy, the portion of the hollow blank to be processed with the pipe thread is firstly performed in the radial or axial or axial radial direction, so that the cross-section of the rolled portion of the hollow blank is formed by rolling from the original random polygons into a regular polygon that can be controlled. The regular polygon conforms to the subsequent thread rolling requirements, and the non-roundness increase during pre-rolling will not exceed 10% of the original one. Wherein a plurality of spiral lines with controlled length are formed and the residual stress of the hollow blank is partially released to correct the non-roundness of the blank; in order to reduce the radial force of the apparatus during pre-forming rolling, it is preferable to use an axial rolling or axial radial mixing rolling; further to reduce the subversion torque of the apparatus during pre-forming rolling, an axial radial mixing rolling is preferably used; this regular hollow blank with multiple spiral lines with controlled length, port outside diameter and taper which conform to the subsequent rolling requirements matches with the subsequent number of rolling wheels and pipe thread length accuracy, then radial or axial radial mixing pipe thread rolling process is performed, so that the spiral line of the steel hollow blank in the successively multiple rolling processes do not overlap each other and distributed reasonably and equably along the circumference, and the original residual stress of hollow blank is further released, and the stress distribution is more uniform, so as to improve quality the non-roundness and straightness of the pipe thread product, and the pipe thread forming rolling complying with the national standard is completed. The rolling head and apparatus are simple and practical, in line with people's current operating habits.

Particularly preferably, the invention also comprises, prior to the pre-forming rolling, a chamfering process for cutting the port of the cylindrical blank to be provided with thread using a chamfering tool with an axial length of 1-3 pitch, so that stability of the pipe thread rolling process can be further improved.

3. Arrangement of the Pre-Forming Rolling Wheel and Pipe Thread Forming Rolling Wheel in the Process of the Present Invention According to the spirit of the present invention, the number of rolling wheels in two successive rolling steps must be different; that is, in the embodiment with two different process steps of pre-forming rolling and pipe thread forming rolling, the number of rolling wheels for pre-forming rolling and the number of rolling wheels for pipe thread forming rolling must be odd-even different. When the number of rolling wheels for the pre-forming rolling process is an odd number, the number of rolling wheels in the successive pipe thread forming rolling process must be an even number; and when the number of the rolling wheels for the pre-forming rolling process is even, the number of rolling wheels in the successive pipe thread forming rolling process must be an odd number. In the case of even and odd numbers matching, it can significantly improve the yield of pipe thread forming rolling products by effectively controlling the port outer diameter, taper and axial length.

Particularly preferably, in addition to the odd-even different setting of the rolling wheels number, the number of the pre-rolling wheels for correction is greater than or equal to 4, the number of the pipe thread forming rolling wheels is greater than or equal to 3, and the number of the pre-forming rolling wheels for correction is greater than that of the pipe thread forming rolling wheels. Preferably, the pre-forming rolling wheels adopt a smooth rolling wheel axial rolling or axial radial mixing rolling. The length of the pre-forming rolling wheel must be greater than or equal to the axial length of the pipe thread product, preferably a pitch of 1 to 3 teeth larger. Thus, even if the hollow cylindrical blank has a certain degree of non-roundness, for example, when the hollow cylindrical blank has non-roundness of more than 100 μm, the desired external pipe thread can also be well rolled with a yield of more than 99%.

It should be noted that the pre-rolling process in the pipe thread forming rolling process according to the present invention may be implemented by one pre-rolling or may be achieved by multiple rolling operations, for example, performing firstly, secondly, thirdly correcting pre-rolling, and then performing the pipe thread forming rolling, but the number of rolling wheels at two successive rolling steps must be different.

In addition, the number of rolling wheels in two successive rolling steps must be different and mating with the smooth annual rolling wheels and its length. The rolling concept is not only beneficial for pipe thread forming rolling, but also for the roundness correcting, straightening and diameter shrinking of general hollow blank can also bring unexpected benefits. One possible application is to use multiple groups of rolling wheels for straightening, rounding and diameter shrinking of hollow blanks. The number of rolling wheels in successive rolling wheel groups can be provided to be different. In this way, the hollow blank in the prior and inferior multiple rolling process has a no-overlapped spiral, and a hollow blank with a unit cross-section of the non-irregular polygons is pre-rolled into a controllable regular polygons, during which part of the residual stress of the hollow blank is released, and the stress distribution is more uniform, while correcting non-roundness of the blank; then the regular polygons matches with the number of the follow-up correcting rolling wheels, making the original residual stress of the hollow blank is further released, thereby enhancing the quality of the roughness and the straightness of the hollow blank. This application is expected to replace the steel drawing technology current commonly used in steel pipe industry.

Figure 6:
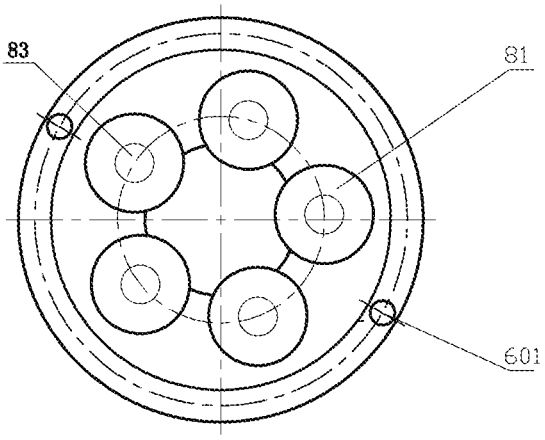
FIG. 6 is an embodiment of a pre-forming rolling head with five rolling wheels according to the present invention.
Figure 6:
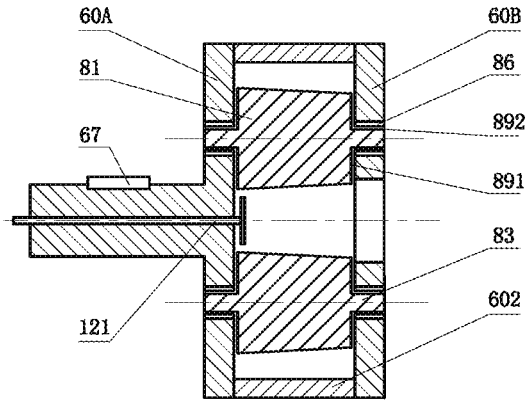

FIG. 6 shows a schematic view of a pre-forming rolling head with only one rolling wheel disc 60 according to the present invention. In this embodiment, the number of pre-forming rolling wheels 81 is five, and the five pre-forming rolling wheels are equally distributed around the processing axis of the hollow blank. The rolling head is rotated by the power motor via the pin 67, to form a structure of the rolling wheel 81 around the rolling wheel axle 83.

Figure 7:
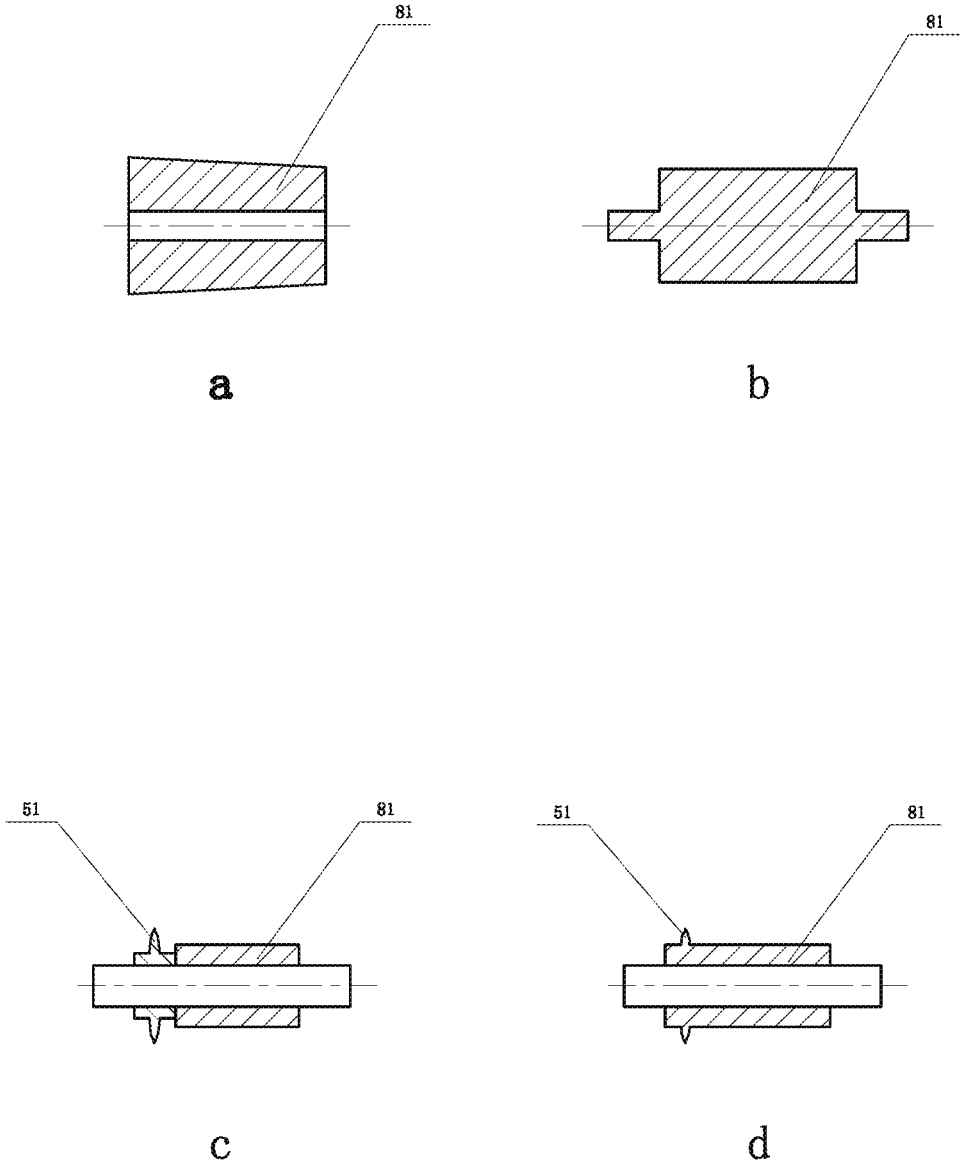
FIG. 7 is a schematic structure view of four kinds of pre-forming smooth rolling wheels according to the present invention.

FIG. 7 shows an embodiment of a plurality of pre-forming rolling wheels of the present invention. The pre-forming rolling wheel of the present invention may be a smooth-surfaced conical rolling wheel (7*a*), a cylindrical rolling wheel (7*b*) with a smooth annular rolling wheel and a rolling wheel axle formed integrally, a cylindrical rolling wheel (7*c*) in combination with cutting tools and a cylindrical rolling wheel (7*d*) which are integrally provided with the cutting tools, and so on. Using the rolling wheels with cutting tools, the hollow blank can be formed with the desired cylindrical or conical surface or cylindrical conical mixing surface at the same time to complete the hollow blank cutting, greatly improving the external pipe thread processing effectiveness.

Figure 8:
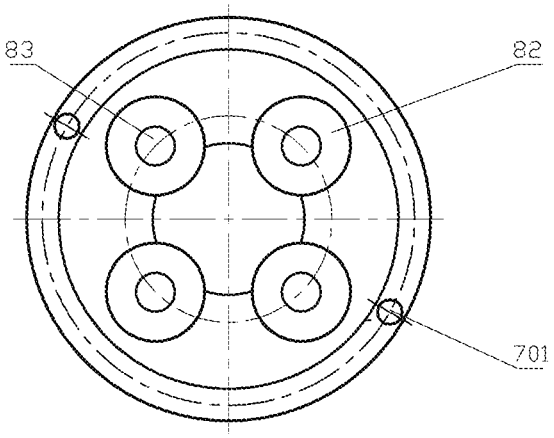
FIG. 8 is an embodiment of the rolling head for forming pipe thread equipped with four rolling wheels and with a rolling wheel disc and an adjusting disc according to the present invention, which is matched with FIG. 6.
Figure 8:
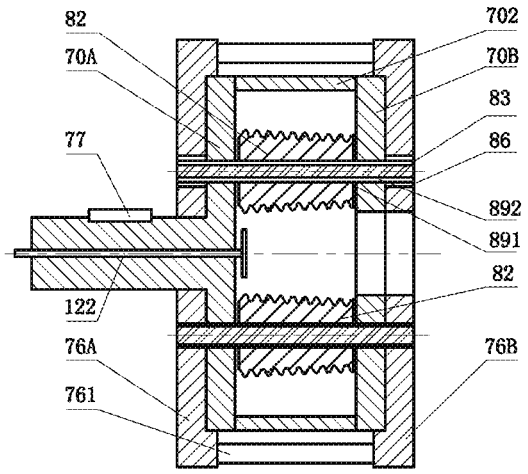

FIG. 8 shows a schematic view of a rolling head corresponding to FIG. 6 for forming pipe thread of the present invention, which includes a radial adjusting disc 76 and a rolling wheel disc 70, comprising four pipe thread forming rolling wheels 82. The four pipe thread forming rolling wheels are equally distributed around the processing axis of the hollow blank. The rolling head is rotated by the power motor via the pin 67 to form a structure of the rolling wheel 81 around the rolling wheel axle 83.

In still another embodiment, the number of pre-forming rolling wheels is four, and the number of pipe thread forming rolling wheels is three.

In another embodiment, the number of pre-forming rolling wheels is six, and the number of pipe thread forming rolling wheels is three or five.

In still another embodiment, the number of pre-forming rolling wheels is seven, and the number of pipe thread forming rolling wheels is four or six.

In still another embodiment, the number of pre-forming rolling wheels is eight, and the number of pipe thread forming rolling wheels is five or seven.

In still another embodiment, the number of pre-forming rolling wheels is nine, and the number of pipe thread forming rolling wheels is four, six or eight.

In practice, for hollow blanks below 2 inches, the number of pre-forming rolling wheels and the number of pipe thread forming rolling wheels neither do not generally exceed 15, preferably 4, 5, 6, 7, 8 or 9;

In practice, for hollow blanks of 2 to 4 inches (including 2 inches and 4 inches), the number of pre-forming rolling wheels and the number of pipe thread forming rolling wheels neither do not generally exceed 19, preferably 4, 5, 6, 7, 8, 9, 10 or 11;

For hollow blanks above 4 inches, the number of pre-forming rolling wheels and the number of pipe thread forming rolling wheels neither do not exceed 35, preferably 4, 5, 6, 7, 8, 9, 10, 11, 12, 13, 14, 15, 16, 17, 18, 19 or 20.

The number of pre-forming rolling wheels and the number of pipe thread forming rolling wheels vary from 1 to 11, preferably 1, 3, 5 or 7. The different numbers may be the number that the number of the pre-forming rolling wheels is more or less than the number of the pipe thread forming rolling wheels. It is preferable that the number of the pre-forming rolling wheels is more and odd-even matched, so as to reduce the number of pipe forming rolling wheels and thereby reduce the difficulty of teeth alignment during pipe thread rolling.

It should be noted that the relationship between the number, the taper and the length of the pre-forming rolling wheels, and the number of pipe thread forming rolling wheels, the length accuracy of the pipe thread products can be increased, decreased or matched according to the outer diameter, the wall thickness and the material, non-roundness of the hollow blank, rolling wheel diameter size, rolling wheel form, thread profile and rolling thread length accuracy requirements, and so on.

The form of the pre-forming rolling wheels and the pipe thread forming rolling wheels is preferably a structure in which the rolling wheel and the rolling wheel axle are integrated. In this way, the number of rolling wheels can be effectively increased, which is beneficial to reduce the times of rolling in stages and prolonging the life of the rolling wheel.

In an embodiment of a preferable pre-forming rolling and pipe thread forming rolling head, there is an axially free movable space 891 (FIGS. 6*b* and 8*b*) between the rolling wheel and the rolling wheel seat, of course there is a certain radial movable space 892 (FIGS. 6*b* and 8*b*). The movable space means that there is a space for the rolling wheel to move freely in the space. The axial movable space refers to the movable space of the rolling wheel in the axial direction of the rolling wheel axle. The axial distance of the axial movable space refers to the maximum distance for rolling wheel freely movable in the axial direction of the rolling wheel axle. The radial movable space refers to the movable space of the rolling wheel movable in the vertical direction of the processing axis along the hollow blank, and the radial distance of the radial movable space refers to the maximum distance of the pipe thread forming portion for the rolling wheel freely movable in the vertical direction of the processing axis of the hollow blank relative to the hollow blank to be processed.

Implementation of the movable space can be referenced to the patent WO2014056419A1. In a preferred embodiment, the rolling wheel and the rolling wheel seat or the rolling wheel axle and the rolling wheel seat may be a shaft hole free movable cooperation. FIGS. 6*b* and 8*b* shows this type of cooperation, wherein FIG. 6*b* is a schematic structural view showing a pipe thread forming rolling head which only comprises a rolling wheel disc, wherein the rolling wheel and the rolling wheel axle are integrated; FIG. 8*b* shows a schematic structural view of a pre-forming rolling head including a rolling wheel disc and a adjusting disc. The rolling wheel and the rolling wheel axle are capable of freely cooperating with each other and show the free cooperation schematic view of the rolling wheel and the rolling wheel seat.

It should be noted that the rolling wheel for forming pipe thread of the present invention may be an annular rolling wheel or a thread rolling wheel, and preferably an annular rolling wheel. When the rolling wheel for forming pipe thread adopts an annular rolling wheel, there is a deflection angle of not more than 9 degrees in the vertical direction between the axis of rolling wheel for forming pipe thread and the axis of the workpiece processing working hole; meanwhile, in order to make each annular rolling wheel in the floating space achieve automatic teeth alignment in the most economical way, reduce damage of non-roundness by the rolling pressure on the hollow blank, the rolling wheel for forming pipe thread and its rolling wheel seat or rolling wheel axle for forming pipe thread and the rolling wheel seat can be a shaft hole cooperation with clearance for free movement; and each annual rolling wheel has a surface provided with initial part of the thread. The initial part of the thread refers to thread that firstly contacts the hollow blank when the annual rolling wheel performs the thread rolling process. Preferably the initial part of the thread is designed to have an equal extension or equal indent, and the specific design idea is as follows:

It is assumed that the rolling head for forming pipe thread comprises a total of N annular rolling wheels, starting from one of the annular rolling wheels $R_i$ and the initial part of the thread of the next rolling wheel $R_{i+1}$ in the same clockwise direction is: a thread obtained based on the initial part of the thread of the rolling wheel $R_i$ to extend a distance of 1/N pitch in accordance with the original thread profile and the pitch in the direction of the axis of the rolling wheel $R_i$.

It should be pointed out that the thread obtained by extension is a hypothetical concept and is described in detail below in conjunction with an embodiment of the present invention.

Figure 9:
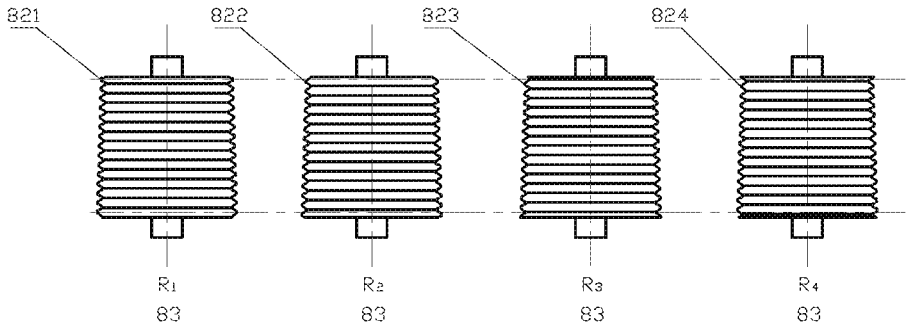
FIG. 9 is a schematic view showing the position distribution of the initial portion threads 821, 822, 823 and 824 of each annular rolling wheel in the embodiment of the rolling head for forming pipe thread of the present invention including four annular rolling wheels.

FIG. 9 shows the position distribution of the initial part threads 821, 822, 823 and 824 of the respective annular rolling wheels in the rolling head for forming pipe thread including four annual rolling wheels according to the present invention.

In the figures, each annular rolling wheel is arranged in a row from left to right according to the order of clockwise arranged in the rolling head for forming pipe thread. The initial part thread 821 of the annular rolling wheel $R_1$ is shown as a complete annual threads starting from the tail of the tooth; the initial portion thread 822 of the rolling wheel $R_2$ is a thread obtained by extending the initial portion thread 821 of the rolling wheel $R_1$ by a distance of ¼ pitch in the axial direction of the rolling wheel $R_1$; the initial portion thread 823 of the rolling wheel $R_3$ is a thread obtained by extending the initial portion thread 822 of the rolling wheel $R_2$ by a distance of ¼ pitch in the axial direction of the rolling wheel $R_2$; the starting portion thread 824 of the rolling wheel $R_4$ is a thread obtained by extending the initial portion thread 823 of the rolling wheel $R_3$ by a distance of ¼ pitch in the axial direction of the rolling wheel $R_3$; a starting portion thread 821 of the rolling wheel $R_1$ is a thread obtained by extending the initial portion thread 824 of the rolling wheel $R_4$ by a distance of ¼ pitch in the axial direction of the rolling wheel $R_4$.

4. The Structure of the Rolling Head

The pre-forming rolling head and the rolling head for forming pipe thread according to the present invention may adopt the same or similar structural design. In a specific embodiment, both the pre-forming rolling head and the rolling head for forming pipe thread can adopt a structural design with a rolling wheel disc and an adjusting disc or a structural design with only a rolling wheel disc. FIGS. 10 to 16 describe in detail an embodiment of a universal rolling head structure of the present invention.

Figure 10:
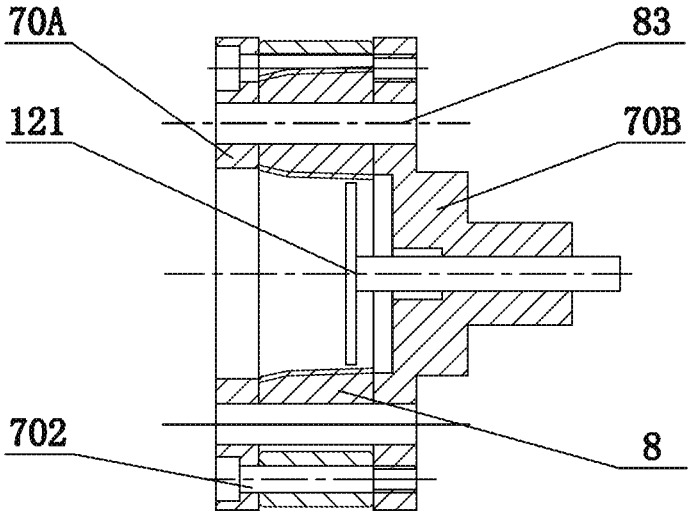
FIG. 10 shows an embodiment of an axially rolling head with only a rolling wheel equipped with a photo-induced mechanical device according to the present invention.
Figure 11:
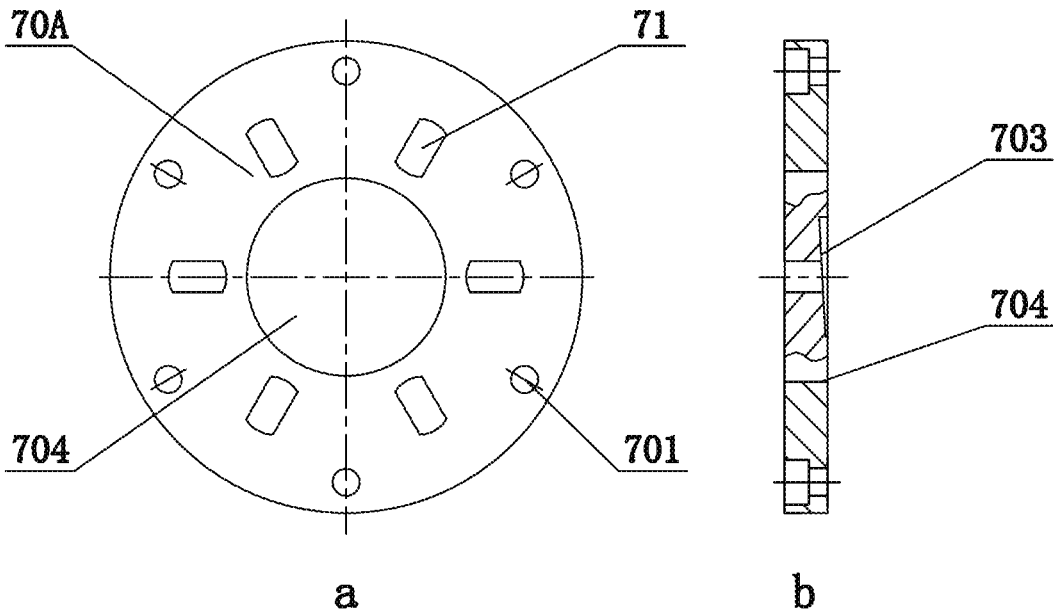
FIG. 11 is a schematic structure view of a rolling wheel disc with six rolling wheels in the rolling head of FIG. 10.

FIG. 10 is a schematic structural view of an embodiment of an axially rolling head according to the present invention. FIG. 11 is a schematic view of the structure of a rolling wheel disc with six rolling wheels in the rolling head of FIG. 10. In which FIG. 11*a* is a front view of the rolling wheel disc, and FIG. 11*b* is a side view of the rolling wheel disc. As shown in FIGS. 10-11, the rolling head comprises front and rear rolling wheel discs (70A, 70B), a rolling wheel axle 83 matched with the radial groove 71 on the rolling wheel disc and rolling wheel 8 thereof, and a connecting pin 702 matched with the pin hole 701 on the rolling wheel disc; a workpiece processing hole 704 is provided at the center of the rolling wheel disc, and the mounting surface of the radial groove 71 of the rolling wheel disc to the rolling wheel is an inclined plane 703; the rolling wheel axle 83 is mounted on the radial groove 71 of rolling wheel disc by two end inclined planes 832*a* and 832*b* matched with the radial grooves 71 on the rolling wheel disc, and the shape and size of the groove 71 allows the rolling wheel axle 83 to be axially mounted. The two rolling wheel discs 70A and 70B are connected and fixed with each other through the connecting pin 702 of the rolling wheel disc to form the rolling head coaxially. In addition, a rolling time and position control adjusting rod 121 is provided at the end of the rolling head for controlling the pre-forming rolling time and the rolling axial length.

Figure 12:
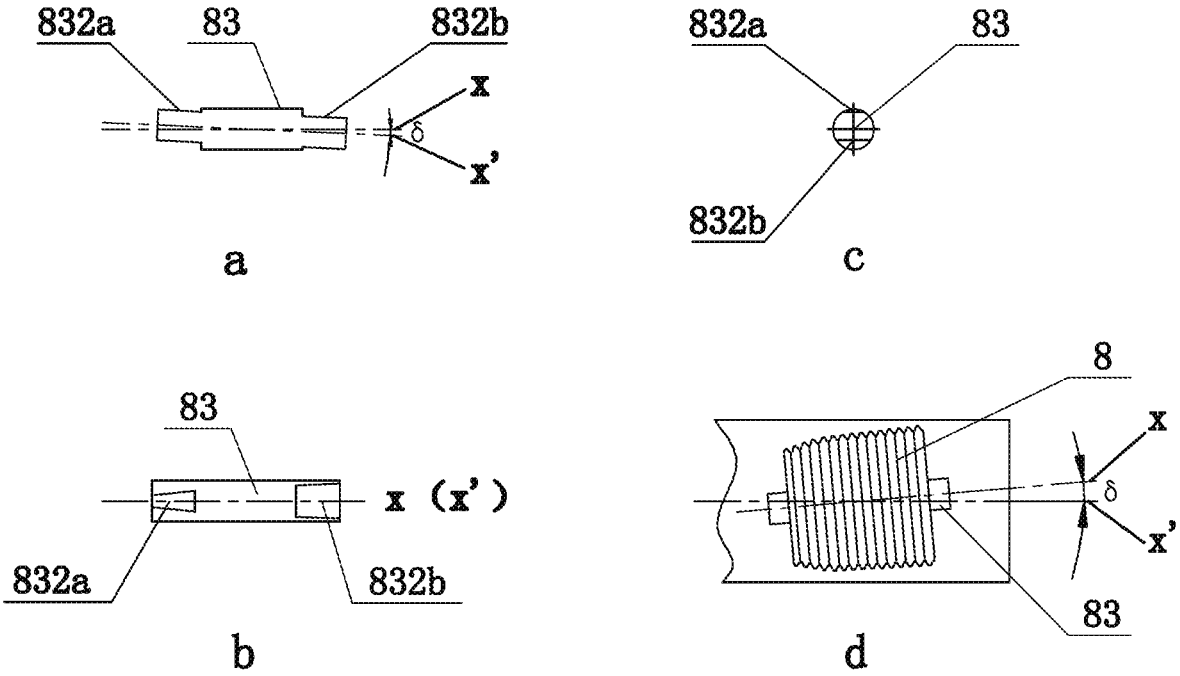
FIG. 12 is a schematic structure and installation view of the rolling wheel axle in the rolling head of FIG. 10.

FIG. 12 is a three-dimensional view of the structure of the rolling wheel axle in the rolling head of FIG. 10 and a schematic view of the radial offset angle δ in the vertical direction provided between the axis of the rolling wheel axle and the axis of the hollow cylindrical blank. In which FIG. 12*a* is a front view of the rolling wheel axle, and FIG. 12*b* is a top view of the rolling wheel axle, and FIG. 12*c* is a side view of the rolling wheel axle.

The two ends of the rolling wheel axle 83 each have upper and lower inclined planes 832*a* and 832*b* parallel to each other. The axis x' of the inclined plane thereof and the axial center line x of the rolling wheel axle form a radial setting angle δ. The axis of the machining center is parallel to x 'and the angle between x and the plane formed by the machining center axis and x' is equal to the radial setting angle δ.

FIG. 12*d* clearly shows that when the rolling wheel is coaxially mounted on the center of the rolling wheel axle, the axis of rolling wheel forms a radial setting angle δ with the inclined planes 832*a*, 832*b*.

Due to the inclined plane 832*a* and 832*b* of the rolling wheel axles, the axial of the installed rolling wheel axle and the axial of the hollow blank forms a spiral rising angle δ, and when the hollow blank and the rolling wheel make mutual contact and rotation with each other, the hollow blank can be moved axially. The greater the spiral rising angle δ is, generally no more than 9 degrees, the faster the hollow blank moves axially. The radial setting angle δ is preferably less than 5 degrees for steel pipes below 2 inches;

and the radial setting angle δ is preferably less than 3 degrees for those with 2 to 6 inches.

Figure 13:
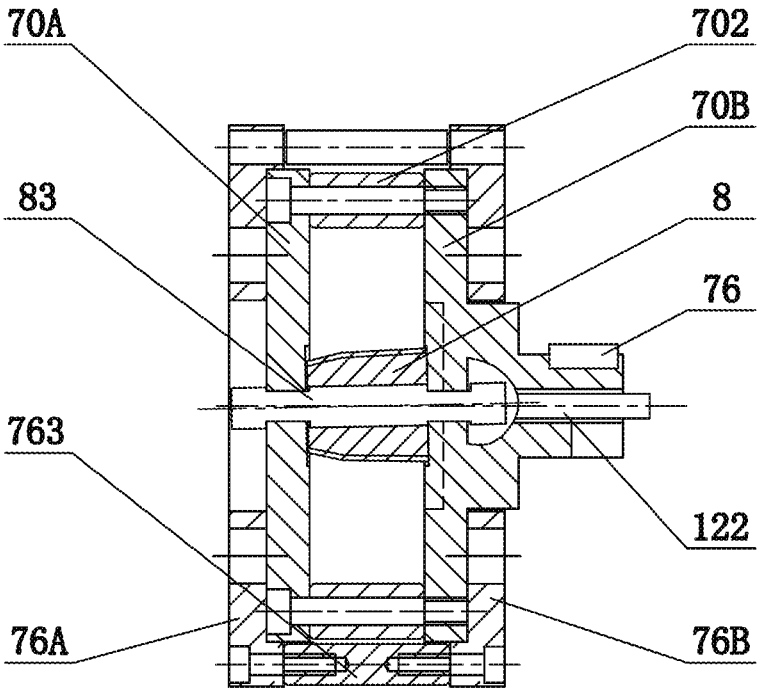
FIG. 13 is a schematic structure view of an embodiment of an axially rolling head further comprising an adjusting disk on the basis of FIG. 10 according to the present invention.

FIG. 13 is an embodiment further comprising a rolling head for axial rolling of the adjusting disk on the basis of FIG. 10 according to the present invention.

Figure 14:
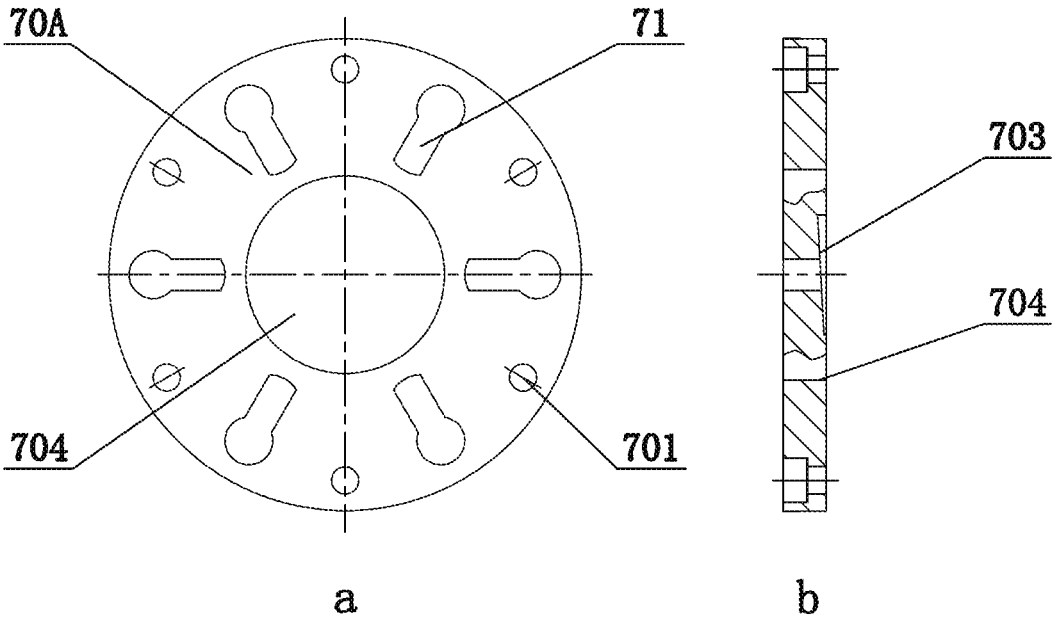
FIG. 14 is a schematic structure view of the rolling wheel disc with six rolling wheels in the rolling head of FIG. 13.

FIG. 14 is a structural diagram of the rolling wheel disc in FIG. 13. FIG. 14*a* is a front view of the rolling wheel disc, and FIG. 14*b* is a side view of the rolling wheel disc. The rolling wheel disc of FIG. 14 is basically similar in structure to the rolling wheel disc of FIG. 11, except the shape of the radial groove 71. The radial groove 71 of the rolling wheel disc in FIG. 14 is a combination of a cylinder and a cuboid. The cylinder exists for the purpose of mounting the rolling wheel axle with a cylindrical end. The radial groove 71 of the rolling wheel disc in FIG. 11 is an approximately rectangular structure, cooperating with the rolling wheel axle with an approximating rectangular end. Other structures are the same, which will not be repeated here.

Figure 15:
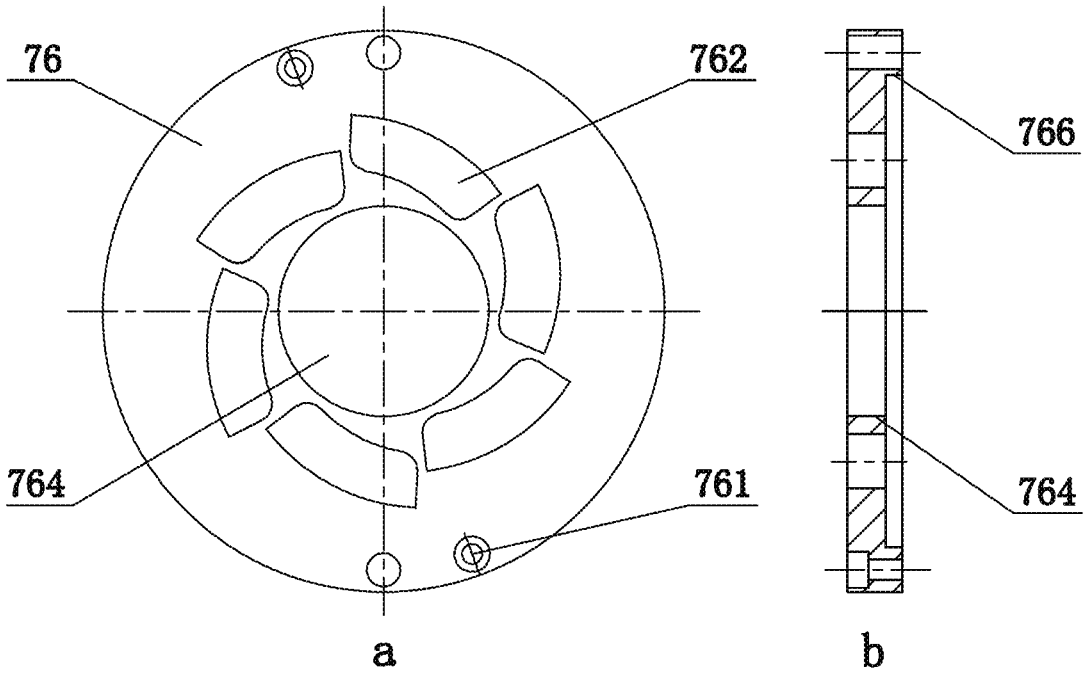
FIG. 15 is a schematic structure view of the adjusting disk in the rolling head of FIG. 13.
Figure 17:
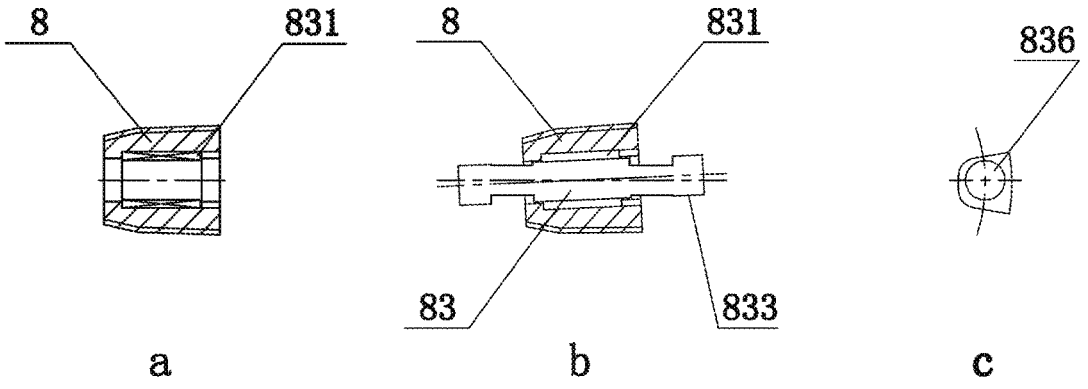
FIG. 17 is a schematic view showing structure of the rolling wheel and cooperation of the rolling wheel, the rolling wheel axle and the rolling wheel axle seat (sliding piece).

FIG. 15 is a schematic structural view of the adjusting disc in the rolling head of FIG. 13. FIG. 15*a* is a front view of the adjusting disc structure, and FIG. 15*b* is a side view of the adjusting disc structure. The radial adjusting device comprises a front and back adjusting disc 76A and 76B and a fixed connecting pin 763 matched with the pin hole 761 on the adjusting disc. The center of the adjusting disc is provided with a workpiece processing working hole 764 matched with the rolling wheel disc and a positioning and mounting blind hole 766 in the adjusting disc which is matched with the rolling wheel disc; the adjusting disc 76 is coaxially mounted front and rear respectively on the outside of the rolling wheel disc through the positioning blind hole 766 of the adjusting disc and are connected to each other by the adjusting disc pin 763 and to form a shaft hole cooperation with the adjusting disc pin; As shown in FIG. 17*c*, by rotating the adjusting disc 76, a sliding piece 836 is mounted on the two ends 833 of the rolling wheel axle and slides in the arc-shape groove 762 of the adjusting disc, so that the rolling wheel axle 83 moves radially in the radial groove 71 of the rolling wheel disc 70 to form a rolling head whose radial position is adjustable with respect to the rolling wheel. In addition, a rolling position photo-sensing control adjusting rod 122 is provided on the side where the rolling head is finished rolling for controlling the rolling time and the rolling length. It should be noted that when the pre-forming rolling head adopts the structure as shown in FIG. 10 and the pipe thread forming rolling head adopts the structure as shown in FIG. 13, the pre-forming rolling time controlled by the photo-sensing control adjusting rod 121 in FIG. 10 and the thread rolling time controlled by the control adjusting rod 122 in FIG. 13 must be matched reasonably in order to roll out the qualified pipe external thread product. The power motor is rotated by the rolling head driven by the pin 77 so that the rolling wheel 8 surrounds the rolling wheel axle 83.

Figure 16:
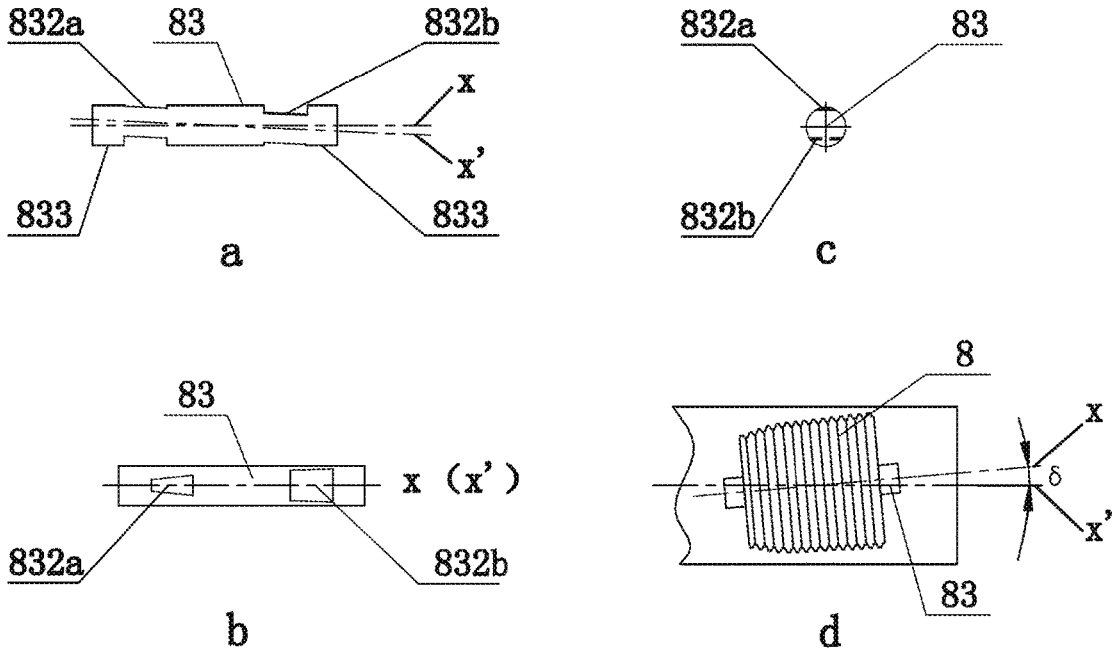
FIG. 16 is a schematic structure and installation view of the rolling wheel axle in the rolling head of FIG. 13.

FIG. 16 is a three-dimensional view of the structure of the rolling wheel axle and its radial offset angle according to the present invention. FIG. 16*a* is a front view of the rolling wheel axle, FIG. 16*b* is a top view of the rolling wheel axle, and FIG. 16*c* is a side view of the rolling wheel axle, and FIG. 16*d* is a schematic view showing the angle δ provided in the vertical direction between the rolling wheel axis and the hollow cylindrical blank axis.

FIG. 17*a* is a schematic view of the structure of a rolling wheel according to the present invention. The rolling wheel includes a guiding-in portion and a rolling portion. The taper of the pre-forming rolling portion on the rolling wheel is 2° to 5°. The taper size of the pre-forming rolling portion is determined according to the essence of the present invention, preferably 2°30"-4°30". The angle of the guiding-in can be generally 13°; the rolling portion for pipe thread has a pipe thread taper of 1:16.

FIG. 17*b* is a schematic view of the rolling wheel, a needle bearing cooperating with a rolling wheel axle according to the present invention. The cooperation of the rolling wheel 8 and the needle bearing 831 mainly reduces the rotational friction force of the rolling wheel. The rolling wheel 8 is freely mounted on the rolling wheel axle 83 through needle bearings 831. The rolling wheel shaft 83 and the rolling wheel 8 can also be matched with each other by balls, aligning or other bearings;

FIG. 17*c* is a cross-sectional view of a sliding piece that mates with a rolling wheel axle.

As shown in FIG. 17*c*, the two cylindrical ends 833 of the rolling wheel axle 83 are mounted (position adjusting) in the holes of the sliding piece 836 to form a shaft hole fitting; the sliding piece 836 is installed in the arc-shaped slot 762 (FIG. 15*a*) of the adjusting disc, forming a cylinder and circular arc cooperation. In addition, a rolling position control adjusting rod 122 is provided at the end of the rolling head for controlling the rolling time and the rolling length. The rolling wheel disc is movably fixed on the apparatus rack (not shown) by a rolling head frame 68 (as shown in FIG. 18).

The adjusting disc is rotated with respect to the rolling wheel disc. A cam device is provided on the adjusting disc (not shown in the fig.). The cam curve controls the radial distance adjustment of the rolling wheel and the radial opening of the rolling head. When necessary, a position relative rotation detecting device 123 (also not shown in the fig.) can also be arranged between the rolling wheel disc and the adjusting disc for numerical control purpose.

Figure 18:
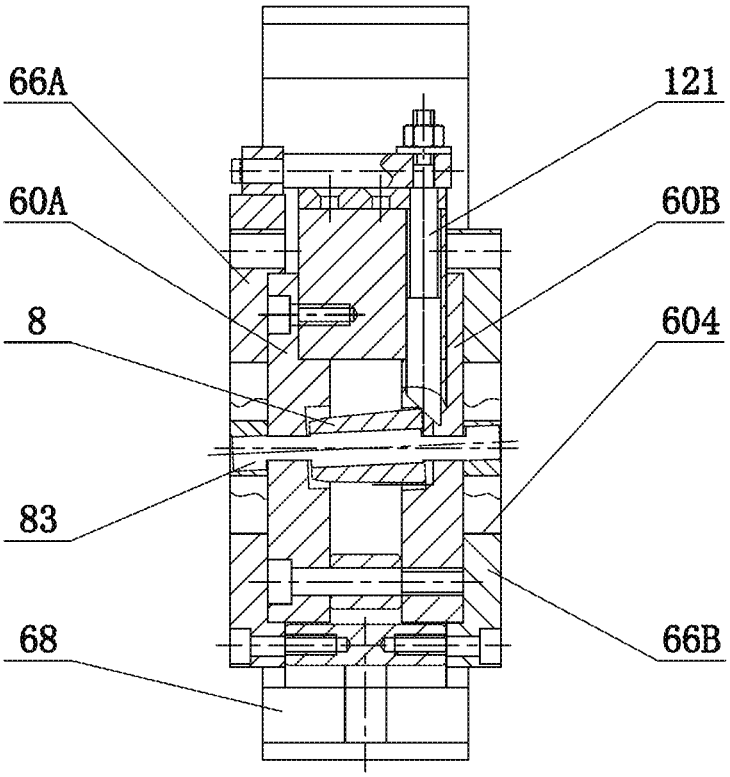
FIG. 18 is another embodiment of a rolling head for axial rolling which includes a photo-induced control-adjusting lever device according to the present invention.

FIG. 18 is a rolling head embodiment that can be passed through by the improved hollow blank on the basis of FIG. 13 rolling in the axial direction.

At the end of the rolling head is mounted with a rolling position control adjusting rod 121 for controlling the rolling time to achieve the control of the length of the rolling thread. Pipe thread rolling time control and pre-forming rolling time and rolling wheel radial position must be a reasonable match. In general, the length of the pre-forming conical or the cylindrical surface or the axial radial mixing surface should be greater than or equal to the length of the pipe thread to be rolled, preferably 1 to 3 teeth greater, more preferably 2 teeth pitch greater.

The setting of the radial position determines the outer diameter of the pre-forming hollow blank end port.

The frame structure 68 of the rolling head of FIG. 18 has holes (not shown) and pins (not shown) on the side end thereof. The frame structure 68 or the side ends of the rolling head are sleeved on the hole of the rolling device carriage, forming a floating connection, so as to achieve self-centering of the rolling module seat and the hollow blank.

Figure 19:
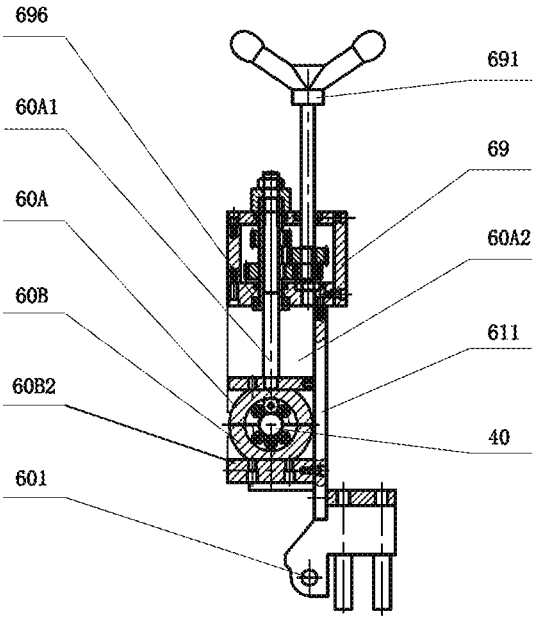
FIG. 19 is an embodiment of a rolling head for a manual axial radial mixing rolling according to the present invention.

FIG. 19 shows a schematic structural view of an embodiment of a manual axial radial pre-forming rolling head of the present invention. The rolling head comprises: an upper rolling wheel seat plate 60A2, a threaded upper rolling wheel seat push rod 60A1, a torque amplifying gear group 69, a screw nut 696, and a rotation handle 691. The upper rolling wheel seat plate 60A2 is fixedly connected to the rolling wheel seat 60A and sleeved on the guiding column 611 to form shaft-hole cooperation. One end of the upper rolling wheel seat pushrod 60A1 is against and fixed to the upper rolling seat plate 60A2, and the other end cooperates with the screw nut 696, and cooperates with the output gear bearing bore in the torque amplification gear group coaxially. The input shaft of the torque amplifying gear group 69 is fixedly connected with the rotation handle 691. The lower rolling wheel seat plate 60B2 and the lower rolling wheel seat 60B are fixedly connected and sleeved and fixed on the guide column 611. When the rotation handle 691 drives the gear input shaft to rotate, the upper rolling wheel seat pushrod 60A1 is driven to move up and down through the torque amplifying gear group 69 and the screw nut 696. When the hollow cylindrical blank 40 is engaged and rotated by the rolling wheel 81, the radial feed rolling of the rolling wheel is completed. When the rolling wheel 81 is arranged so that its axial direction and the hollow blank have a deflection angle δ in the vertical direction (radial direction), the radial rolling becomes an axial radial mixing rolling. When the rolling wheel is a pre-forming rolling wheel with a cutting blade, the rolling head can also complete the cutting process of the hollow cylindrical blank.

The rolling head of FIG. 19 has a hole 601 and a number of pins (not shown) on the side end of the frame structure. The side end of the rolling head is connected to the hole on the roller carriage by the pins to form a floating connection, thereby achieving self-centering of the rolling module seat and the hollow blank.

Figure 20:
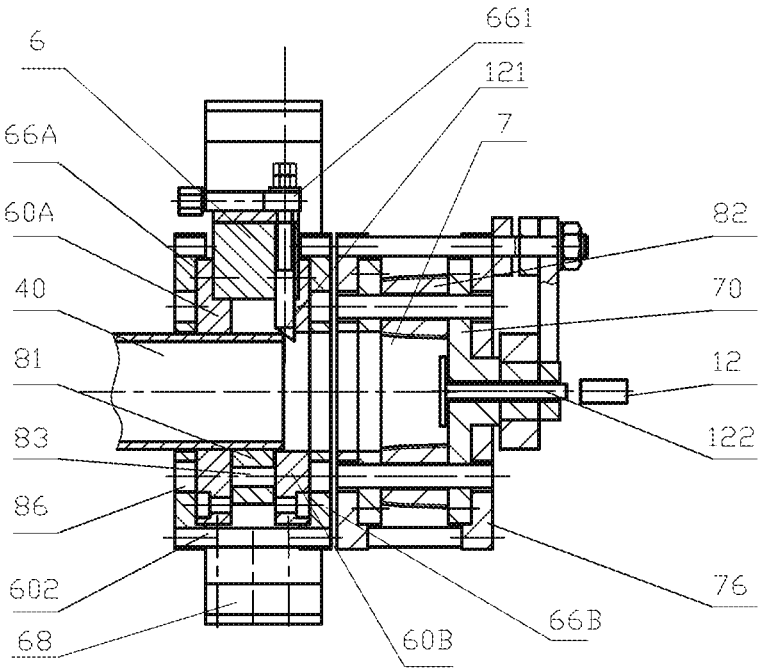
FIG. 20 is a schematic view of a rolling processing module integrally incorporating a pre-forming rolling head and a pipe-thread forming rolling head of FIGS. 13 and 18 according to the present invention.

The self-centering design of the rolling head and the hollow blank of FIGS. 18, 19 and 20 by the floating connection of the shaft hole clearance relative to the rolling head and the base actually solves the problem of the manufacturing and assembling precision of the apparatus and the hollow blank and the concentricity of the actual mounting of the blank, which is also crucial to the rolling. The size of the shaft hole clearance depends on the design and manufacturing precision of the device, preferably no more than +/−1 mm.

While the invention has been described by the preferred embodiments, it is not intended to limit the present invention. Accordingly, it will be appreciated by those skilled in the art that various changes in form and details may be made therein without departing from the spirit of the invention. For example, the structure of the rolling head can also be properly arranged and modified according to the corresponding rolling head device involved in the following patents listed as follows: U.S. Pat. Nos. 5,699,691A, 3,058,196A, EP282889A2, U.S. Pat. Nos. 3,452,567A, 3,058,196A, US20060162411A1, JP10034270A, JP10244340A, JP2003126937A, JP9327742A, CN100542735C, CN2555962Y, CN103264128A, CN103286245A, SU1344479A1, US20120011912A1, U.S. Pat. Nos. 4,617,816A, 4,785,649A, 5,870,918A, GB1150525A, JP1273637A, SU703197A1.

5. One-Piece Rolling Processing Module for Forming Pipe Thread and the Corresponding Rolling Apparatus The pre-forming rolling head and the rolling head for forming pipe thread according to the present invention may be separate or combined into one body. When the two are combined into one, the process can be effectively saved, and the external pipe thread to be processed is formed by rolling sequentially. The overall design is more compact and convenient for transportation and installation.

FIG. 20 shows a schematic view of the structure of a rolling process module in which a pre-forming rolling head 6 and a rolling head 7 for forming pipe thread are combined into one body according to the present invention. On the left is a pre-forming rolling head 6 with five rolling wheels 81 and on the right-hand a rolling head for 7 forming pipe thread with four rolling wheels 82. Structure of the pre-forming rolling head 6 is similar to that of FIG. 18, and the pipe thread forming rolling head 7 adopts a rolling head structure similar to that in FIG. 13. Specifically, the mounting surface of radial grooves (71) in the rolling heads of the rolling wheel (8) may be an inclined plane (703) or a conventional plane (as shown in FIG. 6 or FIG. 8). The specific structural design is not limited to the rolling head structure disclosed in the present invention. In addition, a relative rotational position angle detecting device 123 is provided between the rolling wheel disc and the adjusting disc of the pre-forming rolling head 6 and the pipe thread forming rolling head 7, and can be determined according to the variation of the blank diameter, the wall thickness and the materials and actual requirements of the pipe thread products. When the pipe thread product is required to reach the first step, the radial position of the rolling wheel of the pre-forming rolling head should be reduced to no more than 0.5 mm. When the pipe thread product is required to reach the third step, defining the second pipe thread as standard by screwing tightly on pipe thread by standard ring gauge, the radial position of the rolling wheel of the pre-forming rolling head should be enlarged by no more than 0.5 mm. The length of the pre-forming rolling surface controlled by the rolling time is equal to or greater than that of the pipe thread product, preferably greater by the pitch length of 1 to 3 teeth, more preferably the pitch length of 2 teeth. The pre-forming rolling head 6 and the pipe thread forming rolling head 7 are connected with each other by a pin to ensure that the pre-forming rolling head 6 and the pipe thread forming rolling head 7 are disposed coaxially with the hollow blank to be processed. The workpiece passes through the pre-forming rolling head, directly into the pipe thread rolling.

The hollow blank 40 enters the rolling head from the left and number reference 121 and 122 are used to mark the control adjusting rod with the photoelectric sensing device which controls the pre-forming rolling time and sequence. When the hollow blank 40 completes the pre-forming rolling, its head touches the control adjusting rod 121, the control adjusting rod 121 drives the photoelectric sensing device to work, and the adjusting disc 66 is started to turn in the reverse direction to disengage the hollow cylindrical blank from rolling wheel 81, to complete the pre-forming rolling and come into the right pipe thread forming rolling process. When its head contact the control adjusting rod 122, the photoelectric sensing device operates and starts the adjusting disc 76 to rotate in opposite direction to open, so that the hollow cylindrical blank is disengaged from the rolling wheel 81, to complete the pipe thread rolling, and the process is similar to the foregoing, which are not repeated here.

Figure 21:
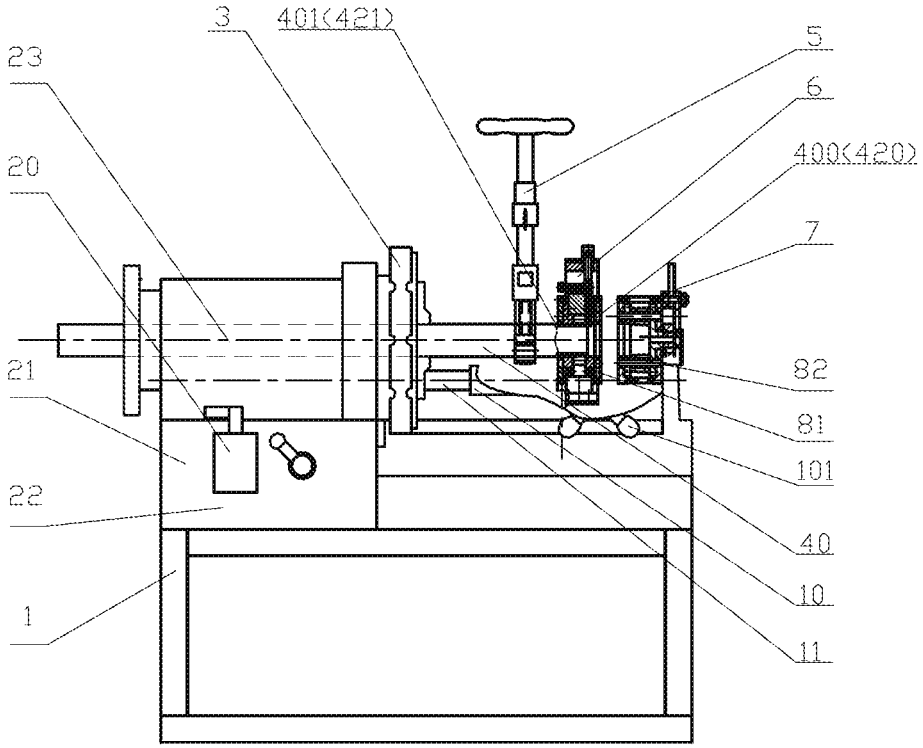
FIG. 21 is an embodiment of an external pipe thread rolling machine comprising the rolling head shown in FIGS. 13 and 18.

FIG. 21 shows a schematic structural view of a single head pre-forming rolling and pipe thread forming rolling apparatus comprising a rolling head shown in FIGS. 13 and 18 with hollow blank rotating. Except for the design of the rolling head, the design of the other components is consistent with the single head pipe thread forming rolling device with the hollow blank rotating as disclosed in the patent WO2014056419A1. The main structure includes a base 1, a power motor 22, a work clamping device 3, a motor control device 20, and a transmission 21 that couples the power motor to the hollow cylinder blank clamping device or the rolling head. The base 1 is provided with the power motor 22, the motor control device 20 and the clamping device 3 for clamping the hollow cylindrical blank to be processed. Under the control of the motor control device 20, the power motor 22 generates a relative rolling and rotational movement of the rolling wheel and the hollow blank 40 clamped by the clamping device 3 through the transmission device 21.

Figure 22:
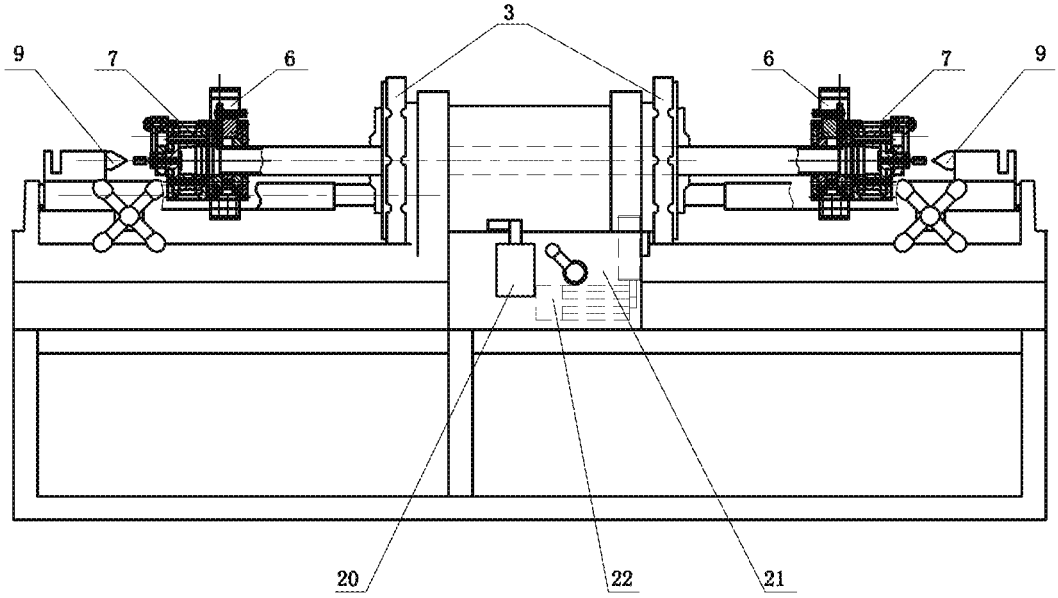
FIG. 22 is another embodiment of an external pipe thread rolling machine comprising two groups of rolling processing modules in FIG. 20.

FIG. 22 is a schematic structural view of a double-ended external pipe thread rolling apparatus which includes two groups of integrated rolling process modules of FIG. 20. Left and right sides in the figure are provided with the hollow blank pre-forming rolling head 6 and the pipe thread forming rolling head 7. The axial and radial mode of operation of the left and right four rolling heads, the basic configuration and function of the device are the same as that in FIGS. 20 and 21, which are not repeated here. According to the need, a chamfering device 9 can be provided to complete the chamfer function.

6. Rotary Rolling Processing Module and Rolling Apparatus

FIGS. 23~31 are distribution structures of four embodiments of the rotary rolling process module according to the present invention. The rolling head is driven to rotate by a power (servo) motor, through mechanical transmission such as a reduction gear box, a worm gear and the like. A pre-forming rolling head, a pipe thread forming rolling head, and other processing tools, such as a nozzle port external chamfering machining tool, an inner hole correction tool, a taper correction tools and thread surface grinding or heat treatment tools etc., are installed in the rolling head through the keyway 67 or 77 in FIG. 10 or FIG. 13. This processing method that a hollow blank is fixed, and the rolling head rotate is suitable for external pipe thread processing of long pipe, especially, it is very meaningful for the oil casing pipe external thread processing. In the casing of the oil pipe threading, the size control of the hole is very important. Thus, we can machine the conic surface by cutting the taper and then roll the external pipe thread without rolling the cylinder or conical surface. The structure of the pre-forming rolling head and the pipe thread rolling head is similar to that shown in FIG. 13, which will not be repeated here.

Figure 23:
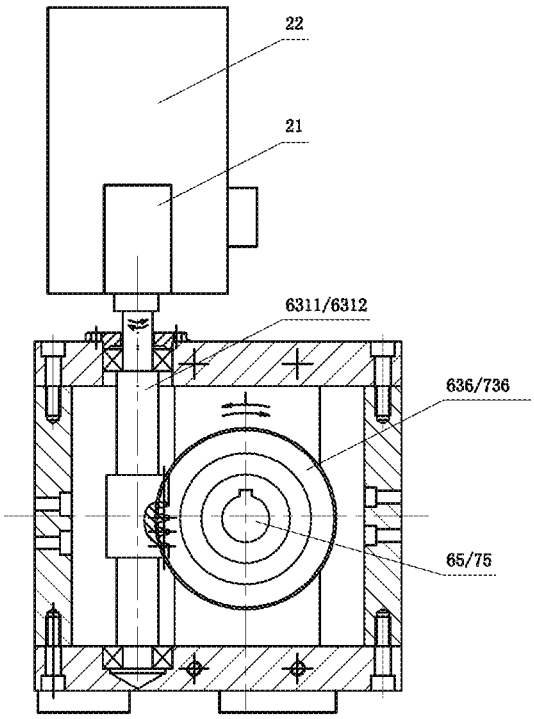
FIG. 23 is a schematic structure view of the rolling processing module including the rotary rolling head seat arranged in the front-to-back direction which is controlled by a single-power or multi-power motor of the rolling tool of FIG. 10 or FIG. 13.
Figure 23:
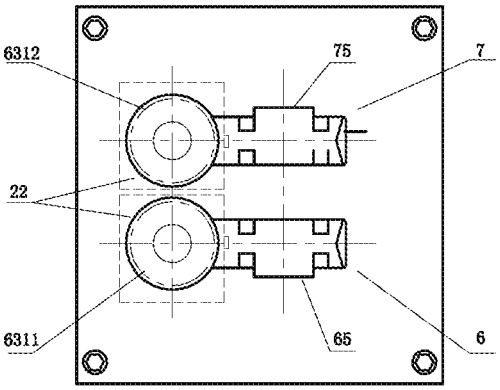

FIG. 23 is a schematic structural view of an embodiment of a rolling process module according to the present invention. The pre-forming rolling head and pipe thread forming rolling head in figure was front and rear arranged. Two (servo) power motors 22 are respectively installed above the middle of the pre-forming rolling head and the pipe thread forming rolling head, and the rotational power is respectively transmitted to the front and rear worm wheels 636 and 736 via the transmission device 21 and the worms 6311 and 6312, and the worm wheels 636 and 736 respectively drives the pre-forming rolling heads 6 (not shown in the figure) and the pipe forming rolling heads 7 (not shown in the figure) on the rolling head seat to rotate through the rolling head seats 65 and 75. It is also possible to install a (servo) power motor whose transmission device 21 controls the worm gear 636 and 736 to transfer correction and the rotation of the pipe thread forming rolling head via the worm gears 6311 and 6312, respectively.

Figure 24:
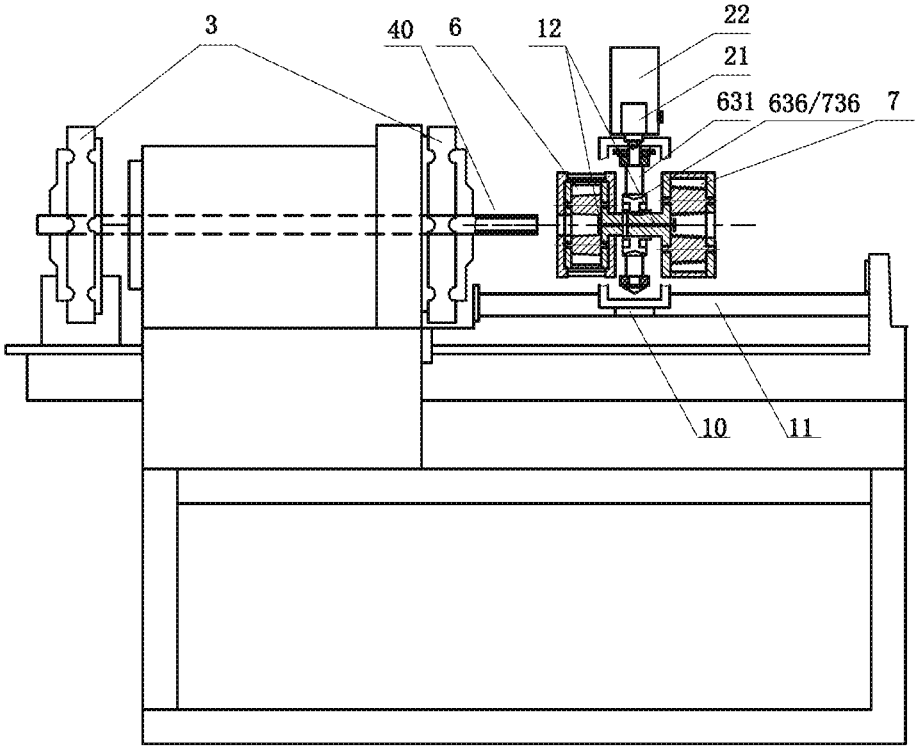
FIG. 24 is a schematic structure view of a rolling apparatus including the rolling processing module of FIG. 23.

FIG. 24 shows a schematic structural view of a pipe thread forming rolling device including the rolling process module of FIG. 23. The pre-forming rolling head and the pipe thread forming rolling head are arranged in a front-to-back horizontal arrangement. The power motor rotates the rolling head through the transmission device 21 and the worm 631. When the motor 22 starts to work, the pre-forming rolling head 6 and the pipe thread forming rolling head 7 are driven to rotate by the transmission device 21, the worm 631 and the worm gears 636 and 736, and the workpiece clamping device 3 installed in the sliding seat 10 is gradually axial fed to the left along the horizontal (left and right) parallel guide rails 11 under the action of rolling axial force, and performs rolling so as to complete the pre-forming rolling. The photoelectric sensing device 12 controls motor reversal, rolling head 6 exits, the workpiece clamping device 3 exits to the right axial to complete the pre-forming rolling station. Subsequently, manually turn the rolling head group 180 degrees, so that the pipe thread forming rolling head 7 come into the station, and the semi-finished blank through pre-forming rolling is axially squeezed into the pipe thread forming rolling head 7 to complete the pipe thread axis forming rolling.

Figure 25:
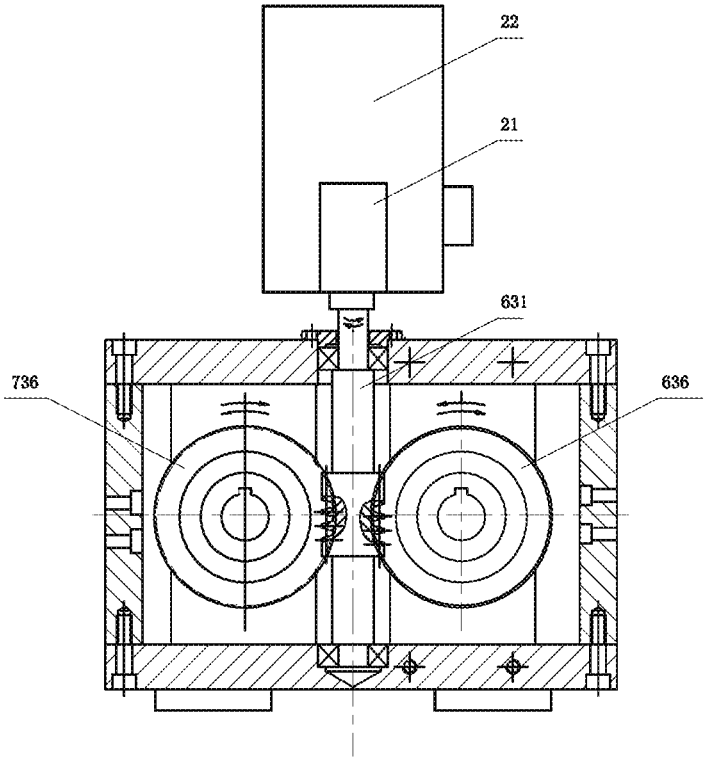
FIG. 25 is a schematic structure view of a processing tool wherein the rolling wheel head of a single-power motor is arranged in parallel according to according to the present invention.
Figure 25:
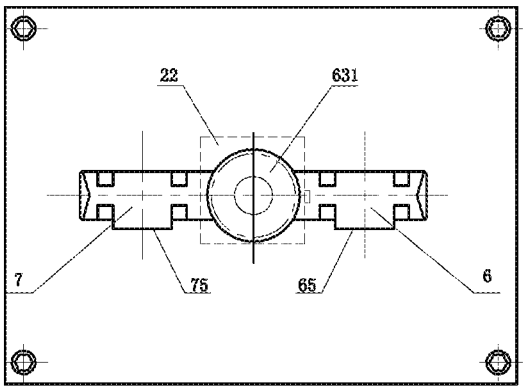

FIG. 25 is a schematic structural view of another embodiment of a rolling process module according to the present invention. Pre-forming rolling head and pipe thread forming rolling head in figure are left and right arranged. The power motor is meshed with gear 21 to decelerate and amplify torque output power. A (servo) power motor 22 is installed above the center of the pre-forming rolling head and the pipe thread forming rolling head, and delivers the rotational power to worm gears 636 and 736 on the left and right sides respectively via a transmission device 21 and a worm 631. The worm gears 636 and 736, respectively, pass through the rolling head seats 65, 75 therein to rotate the pre-forming rolling head (not shown) and the pipe thread forming rolling head (not shown) mounted on the rolling head seat, respectively.

Figure 26:
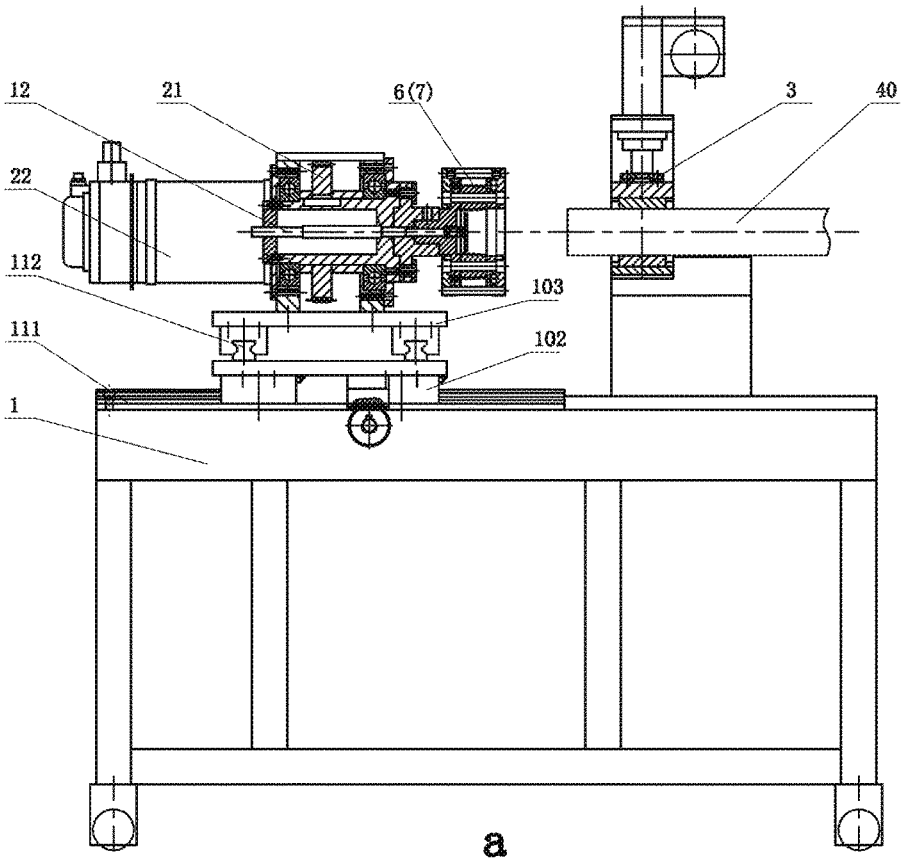
FIG. 26 is a schematic view of an embodiment of a rolling apparatus comprising the rolling head of FIG. 10 or FIG. 13 according to the present invention.
Figure 26:
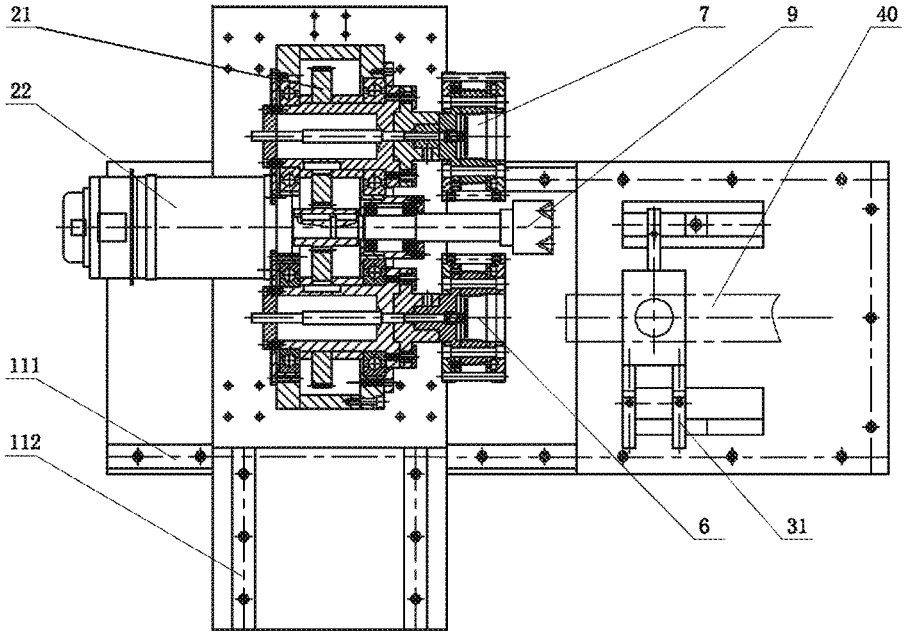

FIG. 26 is a schematic structural view of a pipe thread forming rolling device that includes another rolling process module of the rolling head shown in FIG. 10, FIG. 13, or FIG. 18. The two rolling heads 6 and 7 are arranged horizontally on the left and right, with an outer or inner circular chamfering device 9 therebetween. The hollow blank 40 is clamped and fixed by the workpiece clamping device 3, the chamfering device 9 is coaxial with the hollow blank 40. In the first step, when the motor 22 starts to work, the two rolling heads 6 and 7 of the present invention and the chamfering device 9 are simultaneously rotated by the transmission device 21, and the chamfering device 9 on the sliding seat 9 mounted on the horizontal plane guide rail 111 is axially fed to the chamfering station, and firstly perform external chamfering process of the hollow blank, and the photoelectric sensing device 12 controls the motor to complete the chamfering process and to reverse, and the sliding seat 102 come back to the starting position; In the second step, as shown in FIG. 26*b*, the pre-forming rolling head 6 on the sliding seat 103 moves forward along the front-back planar guide rail 112 until its axis is concentric with axis of the hollow blank, and then the pre-forming rolling head 6 moves axially along the right and left horizontal guide rail 111 to pre-forming station, using axial component to axial pre-form the hollow blank 40 to complete the pre-forming rolling, and the photoelectric sensing device 12 controls the motor reversal, and the rolling head 6 exits; In the third step, the sliding seat 103 moves along front and back planar guide rail 112 so that the axis of the rolling head 7 is concentric with the axis of the pre-formed hollow blank 40, not shown in the figure. The rolling head 7 moves along the horizontal left-right guide rail 111 to the rolling thread station, and uses axial component to perform thread rolling process of the hollow blank to complete pipe thread rolling, then the photoelectric sensing device 12 controls the motor reversal, and the rolling head 7 exits, the rolling process is completed.

The plane movement (front, rear, left and right) of sliding seats 102 and 103 may be performed numerically or manually. Photoelectric sensing devices can be installed on each process, such as external chamfering, pre-forming and thread rolling. The processing time and speed are controlled by control system and the spirit of the present invention. It should be pointed out that it is preferable to adjust the rolling wheel with radial position which can be adjustable according to the outer diameter of the steel blank, its non-roundness, wall thickness and material as well as the subsequent pipe thread requirements; Of course, the number of the rolling wheel in before and after process must be odd and even matching and the total number of rolling wheel.

Figure 27:
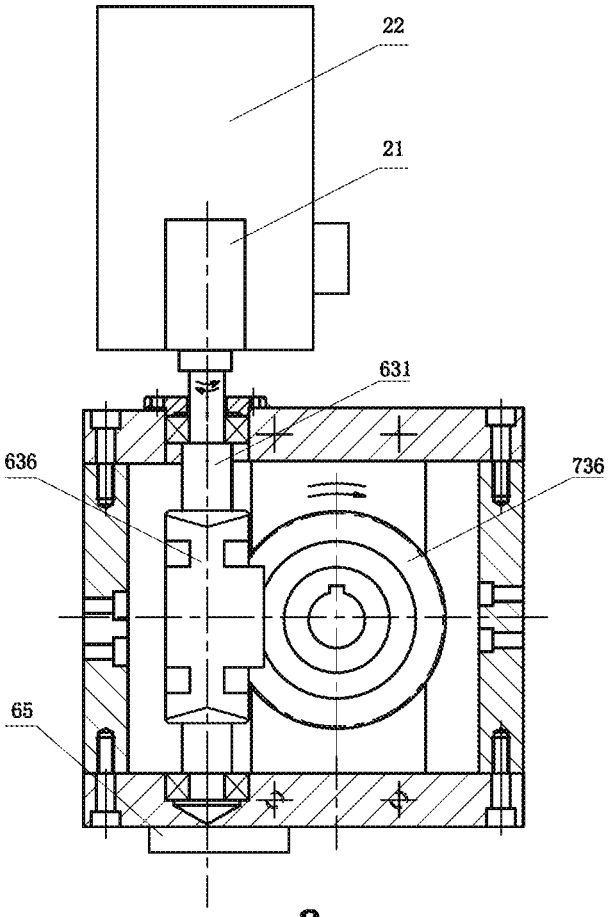
FIG. 27 is a schematic structure view of a rolling processing module comprising the rolling head of FIG. 10 or FIG. 13 and a rotary rolling head seat controlled by single power motor which are arranged as L-shaped according to the present invention.
Figure 27:
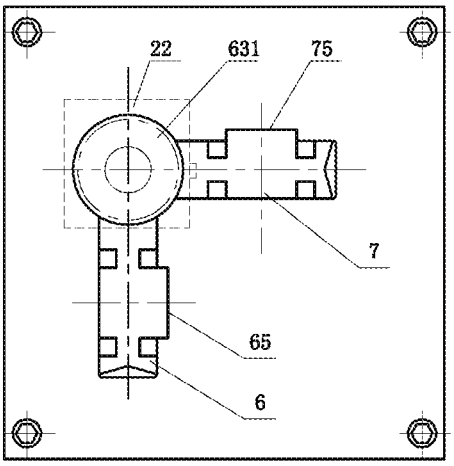

FIG. 27 is a schematic structural view of still another embodiment of a rolling process module according to the present invention. The pre-forming rolling head and pipe thread forming rolling head in figure are L-shaped configured. A (servo) power motor 22 is mounted above the pre-forming rolling head and the pipe thread forming rolling head and transmits rotational power to two groups of the worm gears 636 and 736, respectively, through the transmission device 21 and the worm 631, and then worm gears 636 and 736 pass through the rolling head seats 65, 75 therein to respectively drive the pre-forming rolling head (not shown) and the pipe thread forming rolling head (not shown) mounted on the rolling head seat to rotate.

Figure 28:
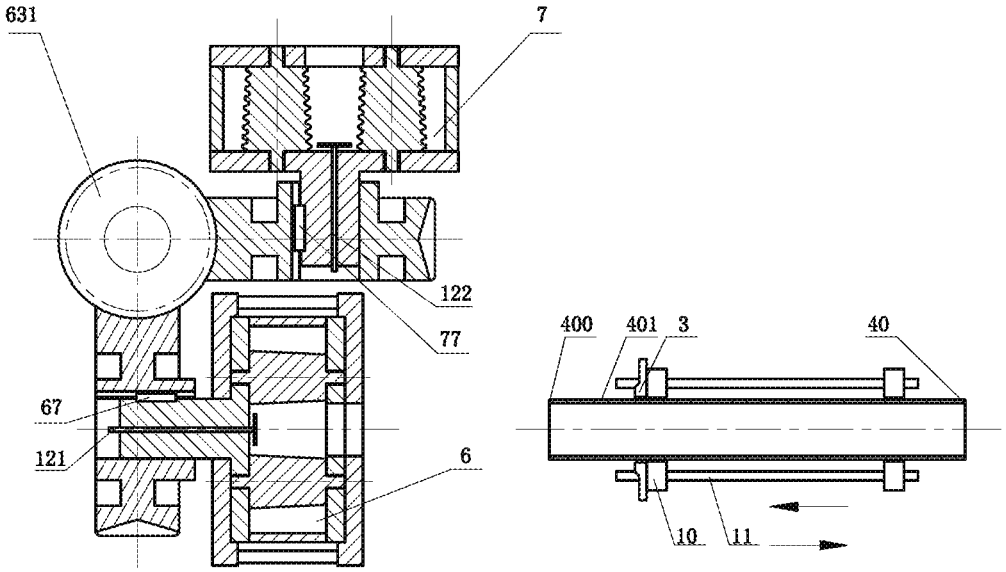
FIG. 28 is an embodiment according to FIG. 27.

FIG. 28 is a further illustration of pre-forming rolling cylindrical blank using the rolling head in L-shaped arrangement of FIG. 27. The movement of the cylindrical blank workpiece and feeding method of rolling head are similar to the foregoing, which will not be repeated here.

Figure 29:
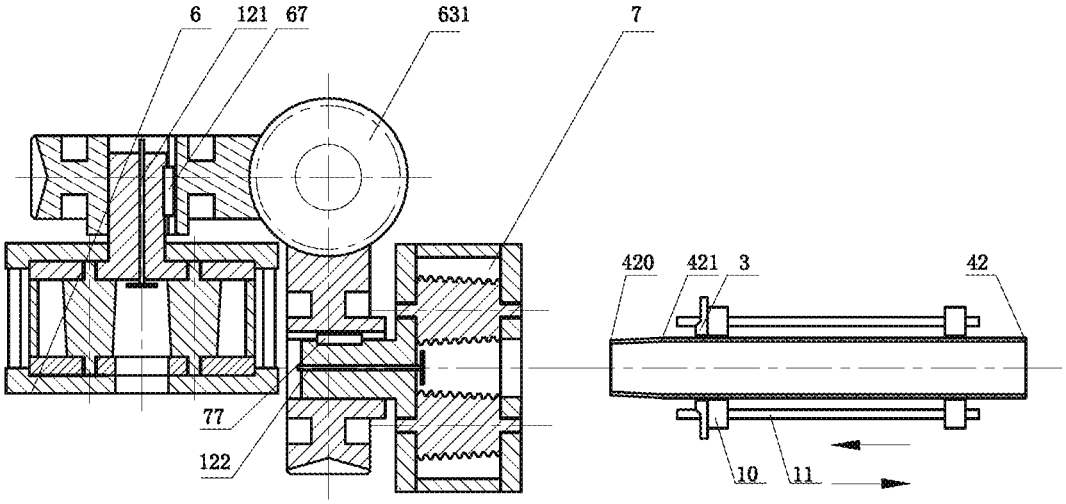
FIG. 29 is a schematic view of the subsequent processing of FIG. 28.

FIG. 29 is an explanatory view of the pipe thread further processed in FIG. 28. When the pre-forming rolling is completed, the rolling head group is rotated by 90 degrees under the action of external force and the pipe external thread processing is continued. The movement of cylindrical blank workpiece and feeding method of rolling head are similar to the foregoing, which are not repeated here.

Figure 30:
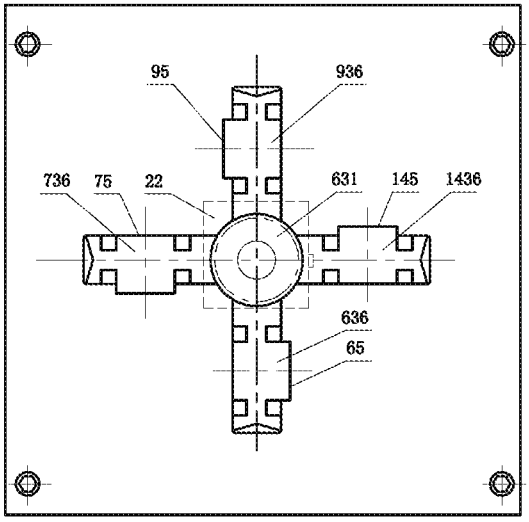
FIG. 30 is a top view of a rolling apparatus comprising the rolling head of FIGS. 10 and 13 and other processing apparatuses which are arranged as a cross in accordance with the present invention.
Figure 30:
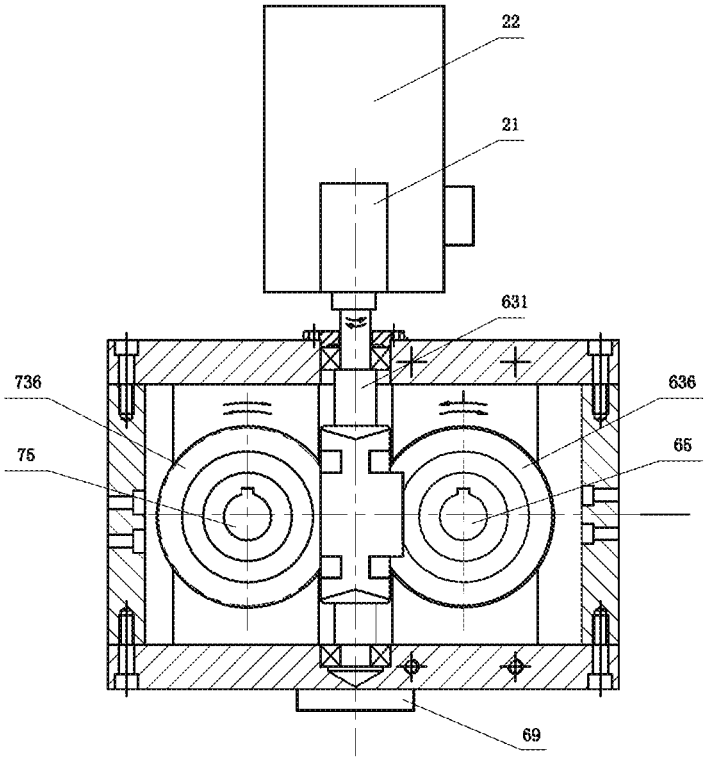

FIG. 30 is a schematic structural view of still another embodiment of a rolling process module according to the present invention. The pre-forming rolling head, pipe thread forming rolling head and other processing group was arranged in a cross shape. A (servo) power motor 22 is mounted above the center of the pre-forming rolling head, pipe thread forming rolling head and other process groups, transmitting the rotational power to the four-sided worm gears 636, 736, 936, and 1436 through the transmission 21 and the worm 631, respectively. The worm gears in turn drive the pre-forming rolling head (not shown) and pipe thread rolling head mounted on the rolling head seat through their respective rolling head seats 65, 75, 95 and 145, respectively (Not shown) to rotate, and subsequent auxiliary machining tools (not shown in the figures, which can be hole, cylindrical, taper or thread surface machined, etc.) to work. The working principle of the auxiliary machining tools is similar to the existing well-known technology and will not be repeated here. Under action of external force, the rolling head group rotates 90 degrees each time, and perform a variety of processing, such as: bore correction 14, end port processing 15, thread induction heat treatment, thread grinding and thread coating processing, and so on, and its work method is similar to the prior art, the and the method that the processing tools are installed on the rolling head seat 1436 and 1536 are in the same manner as described above, which will not be repeated here.

7. Pipe Thread Forming Rolling Production Line

Figure 31:
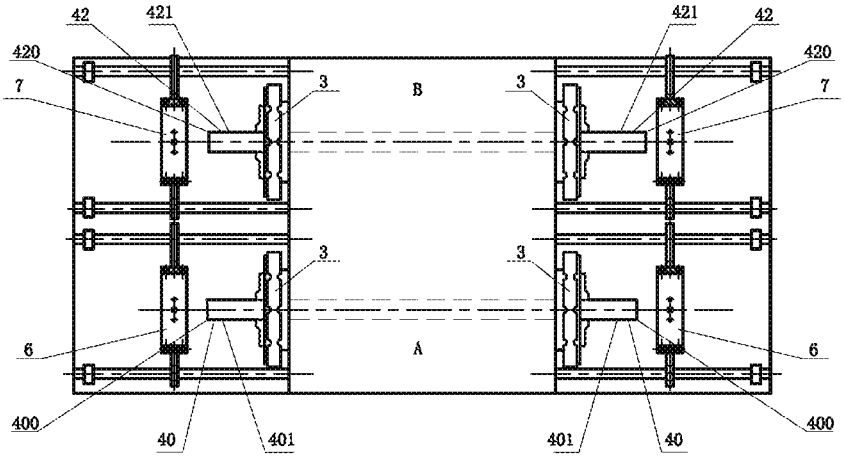
FIG. 31 is a top view of the structure of rolling line for a double-ended conical external pipe thread including the rolling head of FIG. 10, 13, 18, or 20 according to the present invention.

FIG. 31 is a schematic structural view of a double-ended conical pipe thread forming rolling production line according to the present invention.

Left and right sides of the figure are arranged with the hollow blank pre-forming rolling head 6 and pipe thread forming rolling head 7 in front and rear respectively, which separated the pre-forming rolling and pipe thread forming rolling as A station and B station. When the hollow blank 40 is locked and rotated at a set rotational speed by a power motor (not shown), the two left and right first pre-forming rolling head 6 respectively start to pre-forming rolling at 400, i.e. the initial part of the pipe thread to be processed, and then perform thread rolling from the outer to the position 401, i.e. the tail of the pipe thread to be processed, so as to complete the first pre-forming rolling, and the workpiece is released, the pre-forming rolling head 6 exits outward. The robot arm moves the workpiece from the A station to the B station, and lock them again and rotate it by the power motor (not shown) at the set rotation speed. The pipe thread forming rolling head 7 are respectively start round correcting rolling at 420, i.e. the initial part of the pipe thread to be processed, and then perform thread rolling from the outer to the position 421, i.e. the tail of the pipe thread to be processed, so as to complete the pre-forming rolling external thread again, and the workpiece is released, the pipe thread rolling head 7 exits outward. The robot arm moves the external pipe thread product from the station B to the next station, and rolling process for the double-ended conical external pipe thread product is completed. It can also achieve rolling external pipe thread product when changing the pre-forming rolling process into stamping or extrusion process in station A, but the process and product defects have been described above, which will not be repeated here.

8. The External Thread Pipe Processing Embodiment of the Present Invention

The following take the site installation of gas industry commonly used gas-specific galvanized welded pipe with specifications DN32, a length of 6000 mm, a wall thickness of 3.5 mm, non-roundness of 150 um, material Q235 as an example, and reference FIGS. 1, 3, 5, 20 and 21 to compare the existing external thread rolling pipe process, to describe the above-mentioned objects, technical solutions and beneficial effects of the present invention in further detail.

According to the existing national standard "low pressure fluid delivery welded steel pipe" (GB3091~2008) DN32 gas-specific galvanized steel pipe 423 with an outer diameter of 42.4 mm, an ordinary wall thickness of 3.50 mm, and an non-roundness of less than 500 um.

As shown in FIG. 1*a*, the existing external pipe thread rolling process adopts a large-tonnage axial stamping device to first process a 1:16 conical surface 425; as shown in FIG. 1*c*, the pipe thread forming rolling wheel 80 is then used to perform axial rolling process from the pipe port 420, i.e. the initial part 460 of the pipe external thread to be processed, to the position 421, i.e. the tail 461 of the pipe thread to be processed, so as to complete the process of the external pipe thread product 46. This rolling process must have a large tonnage of axial stamping or radial extrusion apparatus, dedicated to the processing of the conical surface 425. At the same time, when the stamping or extrusion pressure is on the conical surface, the pipe material, especially the welded pipe weld 461 at the intersection of the original outer diameter 423 of the steel pipe and the conical surface, causes recessive and dominant damage to the rolling external pipe thread products and leave security risks.

Or we use the method of cutting the conical surface shown in FIG. 1*b*, and the conical surface 425 is machined by the cutting blade 91 in the outer chamfering device 9, with the result that the surface galvanized layer is completely cut and the thickness of the hollow blank is thinned and lost many advantages of the rolling pipe thread, while the processing tools demanding is very high and the processing is difficult.

We also test using three rolling wheels to perform diameter reduction and taper rolling as a pre-roll process and the results is that the steel pipe blank has a triangular shape, and its irregularity increased from 150 um to 650 um or so, with an increase of about 225%, beyond the national standard 500 um by about 30%. Then, three pipe thread rolling wheels are used to perform rolling, and the rolling results shows more obvious triangular pipe thread, and non-roundness is further increased, obviously it is waste; or four pipe thread rolling wheels are used to perform rolling, the rolling still shows triangular circular pipe thread, and the non-roundness of the thread outer diameter is greater than 2 mm, and apparently it is waste.

In order to solve the aforesaid problems, as shown in FIGS. 3*b*, 5*b*, 5*d*, 20 and 21, the hollow blank 40 is manufactured by the pre-forming rolling method of the present invention by using a conical smooth rolling wheel 81, so as to perform conical pre-forming rolling, and steel pipe residual stress is partially released. As the port medium diameter and tooth height of DN32 55 degrees national standard pipe thread is 39.64 mm, 1.479 mm. The material of the hollow blank is Q235, which belongs to medium-low-carbon steel. According to the spirit of the present invention, taking the tooth height of 80%, that is 1.18 mm, so that the outer port of pre-formed hollow blank has a diameter of 40.82 mm, and the taper of pre-formed conical surface 425 is 2° 59'. As shown in FIG. 21, the rolling head is used to start pre-forming rolling at 400, i.e. the initial part 420 of the pipe external thread to be processed, and then axial pre-forming rolls to 401, i.e., the tail part 421 of the pipe external thread to be processed, using the axial component force generated by the deflection angle of the rolling wheel 81 on the rolling head and the hollow blank 40 during the rolling process so as to form the conical surface 425; afterwards, the blank formed with the conical surface 425 enters the axial pipe thread forming rolling process. As shown in FIG. 5*b*, the rounding correction and external thread forming process are produced under the action of the rounding correction external pipe forming rolling wheel 82. The hollow blank 40 with standard D32 steel pipe external outer diameter forms an acceptable external pipe threads at 480 and 481. Due to adopting the same apparatus and the direct rolling method of same power motor, the structure of the apparatus is greatly simplified and portable, laying a foundation for the popularization of rolling process for external pipe thread. At the same time, due to the rejection of the stamping process and apparatus, the recessive and dominant failure of the pipe material particularly at the intersection of the standard pipe outer diameter and conical surface by the stamping pressure on conical formed surface, is avoided, and greatly reduces the potential safety hazard caused by the existing rolling technology. At the same time, the problem that galvanized coating is damaged and the steel pipe is thinned, and other issues, is avoided, and the rolling failure caused by deformation of hollow blank due to the rolling out the conical surface or diameter reduction into a cylindrical surface by the radial three rolling wheels is also avoided.

The specific processing steps will be described in further detail below with reference to FIGS. 20 and 21. Firstly, DN32 of the aforementioned standard steel pipe outer diameter blank 40 is placed in the clamping device 3 and clamped, the motor switch 20 is opened to rotate the hollow blank 40, and the floating rolling material cutting device 5 is manually fed according to the process in radial direction, roll and cut off the hollow blank 40 from length of 6000 mm to the desired length of 2750 mm, manually rotate in opposite direction and loose the rolling material cutting device 5, and turn off the motor switch 20, so as to complete the processing in the cutting station. The pre-forming rolling device 6 is manually fed axially by the crank handle 101 to the machining position 400 which is the position of the initial part 420 of the external pipe thread to be processed. The rolling wheel 81 in the floating pre-forming rolling device 6 is manually moved to axially contact processing position 400 for the hollow blank 40. The hollow cylindrical blank 40 is guided in and was axial pre-forming rolling fed using the deflection angle between the pre-forming rolling wheel with smooth conical surface and the hollow blank 40. After the pre-forming rolling, that is, when the rolling wheel reaches the tail portion 401 of the hollow blank, the photoelectric sensing device controls the adjusting contact rod 121 to work and the motor rotates in the reverse direction, and then manually moves the radial position control rod on the pre-forming rolling control panel (not shown), so that the rolling wheel 6 in the pre-forming rolling device is separated from the hollow blank 40, and then continue to rotate the handle 101 in the same direction, and manually move the rolling wheel 82 in floating pipe thread forming rolling floating device 7 to axially contact with the processing position 420 of conical blank 40. The conical blank is guided in and axially fed to correct round and pipe thread forming rolling via the guided deflection angle between spiral rising angle and the hollow blank 40. After the pipe thread forming rolling is completed, that is, when the rolling wheel reaches the tail portion 421 of the hollow blank, the photoelectric sensing device controls the adjusting contact rod 122 to work and the motor rotates in the reverse direction, and then manually moves the control rod on the pipe thread forming rolling control panel (not shown), so that the rolling device is separated from the pipe external thread product, and the rolling process is completed. In the process of pipe external thread rolling, according to the rolling process needs, the floating chamfering device can be used together.

In combination of and comparing FIGS. 1 to 8 and FIGS. 20 and 21, it is obvious of the difference between the method for manufacturing the external pipe thread product, the rolling head and device thereof of the present invention and the method for manufacturing external pipe thread product, rolling head and device thereof in the prior art, and the beneficial effects is as follows: wider applicability, product qualification rate greater than 99%, and the processing step similar to the current 100% using process of cutting threading in site, the processing device simple and portable, comply with people's current habits, and easy to promote a large number of use.

While the invention has been described by the preferred embodiments, it is not intended to limit the invention. Accordingly, it will be appreciated by those skilled in the art that various changes or replacement in form and details may be made therein without departing from the spirit of the invention, and is not limited by the rolling method and direction, the length of the rolling wheel, the number and installation form of the rolling wheel, the number and installation form of the rolling head, the radial and axial movement of the rolling wheel seat, and the like. For example: the cutting point of pre-forming rolling wheel and pipe thread forming rolling wheel can be started from the initial portion of the external pipe thread, and it can be started from the tail of the effective thread or the tail of full thread or other non-threadable end of the full thread to start rolling and cutting toward the initial portion to complete the thread rolling. When the rolling wheel is not completely radially fed into place and axially rolled, we can equate that the rolling wheel on the rolling head is actually an incomplete thread. Each rolling head can be arranged horizontally or vertically. It is particularly pointed out that the pre-forming rolling process of the present invention can be simplified and omitted when the cylindrical blank is completed with a perfect non-roundness by using the existing stamping process and directly enters process of correcting roundness and pipe thread forming rolling. Through reasonable design, we can also combine other steel pipe correcting device with the rolling head and apparatus of the present invention to complete the pipe thread forming rolling. Each rolling wheel can also self-rotate with its own power around the axis of the rolling wheel relative to the hollow blank. For different types of steel pipe, such as carbon steel pipe, stainless steel pipe, copper pipe, titanium steel pipe and special alloy steel pipe, etc, and for different sizes of steel pipe, such as ⅜ inches and 6 inches above, or other non-standard outer diameter hollow blank, different pipe thickness, steel pipe with seam or without, different pipe thread profile, such as NPT, BSPT, API and metric pipe thread, etc., the rolling wheel length and external pipe thread can be determined according to the rolling method disclosed in the present invention.

Finally, it should be noted that the rolling method of the present invention is not only suitable for hollow blank. We can make use of the principle of even and odd numbers different of pre-forming rolling head, and use multiple groups of rolling wheel to roll the blank which needs straightening, shrinking or surface strengthening so that the surface stress distribution of the workpiece is more uniform, thereby improving the roundness, straightness and surface hardness of the blank.

Therefore, the protection scope of the present invention should be considered as defined in the appended claims.

What is claimed is:

1. A method for rolling an external pipe thread, comprising rolling a hollow blank by a first rolling wheel group and a second rolling wheel group in turn, wherein the first rolling wheel group comprises at least four circumferentially arranged first rolling wheels, and the second rolling wheel group comprises at least three circumferentially arranged second rolling wheels, the first rolling wheels are rolling wheels with smooth outer surface, and the second rolling wheels have external pipe thread forming portion, and the method comprises the following steps:

step 1: the first rolling wheel group rolls an outer surface of the hollow blank into a cylindrical surface, a conical surface, or a cylindrical conical mixing surface;

step 2: the second rolling wheel group rolls the outer surface of the hollow blank processed in the step 1 again, so as to form the external pipe thread by rolling;

wherein a number of first rolling wheels in the first rolling wheel group and a number of second rolling wheels in the second rolling wheel group is odd-even different.

2. The method for rolling an external pipe thread of claim 1, wherein the first rolling wheels have one or more of the following features:

a) the first rolling wheels are cylindrical or conical rolling wheel with a smooth outer surface;

b) there is a deflection angle of not more than 9 degrees in a vertical direction between an axis of the first rolling wheels and an axis of the hollow blank to be processed;

c) there is a free movement gap between rolling wheels and their respective rolling wheel seats on which the rolling wheels are located.

3. The method for rolling an external pipe thread of claim 1, wherein a rolling process of the first rolling wheel group and the second rolling wheel group is selected from one of the following options:

a) the rolling process of the first rolling wheel group and the second rolling wheel group is axial rolling;

b) the rolling process of the first rolling wheel group is radial rolling, and the rolling process of the second rolling wheel group is axial rolling;

c) the rolling process of the first rolling wheel group is axial radial hybrid rolling, and the rolling process of the second rolling wheel group is axial rolling.

* * * * *